US007997336B2

(12) United States Patent
Sokol et al.

(10) Patent No.: US 7,997,336 B2
(45) Date of Patent: Aug. 16, 2011

(54) METHOD AND APPARATUS FOR RETRIEVING AN ASSEMBLY FROM A WELLBORE

(75) Inventors: Jonathan P. Sokol, Houston, TX (US); Scott McIntire, Houston, TX (US); Michael Stulberg, Angleton, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 259 days.

(21) Appl. No.: 12/184,785

(22) Filed: Aug. 1, 2008

(65) Prior Publication Data

US 2010/0025047 A1 Feb. 4, 2010

(51) Int. Cl.
*E21B 7/08* (2006.01)
*E21B 23/03* (2006.01)

(52) U.S. Cl. ..... 166/117.6; 166/117.5; 166/382; 166/216; 166/217; 166/377

(58) Field of Classification Search ..... 166/117.5, 166/117.6, 382, 217, 216; 175/81, 82
See application file for complete search history.

(56) References Cited

U.S. PATENT DOCUMENTS

| | | | | |
|---|---|---|---|---|
| 1,951,638 | A | | 3/1934 | Walker |
| 2,132,061 | A | | 10/1938 | Walker |
| 2,409,811 | A | | 10/1946 | Taylor, Jr. et al. |
| 2,506,799 | A | | 5/1950 | Livingston |
| 3,516,703 | A | | 6/1970 | Templeton |
| 3,559,732 | A | | 2/1971 | Tucker |
| 4,273,464 | A | | 6/1981 | Scott |
| 4,750,560 | A | | 6/1988 | Gazda |
| 4,793,411 | A | * | 12/1988 | Zunkel ..... 166/98 |
| 4,913,229 | A | | 4/1990 | Hearn |
| 5,318,132 | A | * | 6/1994 | Odorisio ..... 166/382 |
| 5,335,737 | A | | 8/1994 | Baugh |
| 5,341,873 | A | | 8/1994 | Carter et al. |
| 5,379,845 | A | | 1/1995 | Blount et al. |
| 5,425,419 | A | | 6/1995 | Sieber |
| 5,427,179 | A | * | 6/1995 | Bailey et al. ..... 166/117.6 |
| 5,467,819 | A | * | 11/1995 | Braddick ..... 166/117.6 |
| 5,474,126 | A | | 12/1995 | Lynde et al. |
| 5,493,748 | A | * | 2/1996 | Santo ..... 15/104.04 |
| 5,535,822 | A | | 7/1996 | Schock et al. |
| 5,678,634 | A | | 10/1997 | Rehbock et al. |

(Continued)

FOREIGN PATENT DOCUMENTS

EP 0 701 040 3/1996

OTHER PUBLICATIONS

GB Search Report for Application No. GB0715075.8 dated Nov. 20, 2007.

(Continued)

*Primary Examiner* — Giovanna C Wright
(74) *Attorney, Agent, or Firm* — Patterson & Sheridan, LLP

(57) ABSTRACT

A method and apparatus for retrieving an assembly having a whipstock and an anchor from a wellbore. A method of retrieving an assembly having a whipstock coupled to an anchor from a wellbore may comprise the steps of releasing the whipstock from the anchor in the wellbore, re-engaging the whipstock to the anchor, and retrieving the whipstock with the anchor from the wellbore. An apparatus for use in a wellbore may comprise a whipstock, a latch coupled to the whipstock, and an anchor operable to be selectively retrieved from the wellbore using the latch.

36 Claims, 16 Drawing Sheets

U.S. PATENT DOCUMENTS

| | | | | |
|---|---|---|---|---|
| 5,787,982 | A | 8/1998 | Bakke | |
| 5,971,078 | A | 10/1999 | Ritorto et al. | |
| 6,050,341 | A | 4/2000 | Metcalf | |
| 6,131,953 | A | 10/2000 | Connell et al. | |
| 6,170,578 | B1 | 1/2001 | Edwards et al. | |
| 6,186,233 | B1 | 2/2001 | Brunet | |
| 6,213,206 | B1 | 4/2001 | Bakke | |
| 6,408,946 | B1 | 6/2002 | Marshall et al. | |
| 6,464,002 | B1 | 10/2002 | Hart et al. | |
| 6,591,905 | B2 | 7/2003 | Coon | |
| 6,843,314 | B2 | 1/2005 | Toulouse et al. | |
| 7,077,204 | B2 | 7/2006 | Cruickshank et al. | |
| 7,100,696 | B2 | 9/2006 | Marshall | |
| 7,152,674 | B2 | 12/2006 | Bowles | |
| 7,174,963 | B2 | 2/2007 | Bertelsen | |
| 7,178,589 | B2 | 2/2007 | Campbell et al. | |
| 7,353,867 | B2 | 4/2008 | Carter et al. | |
| 2002/0070018 | A1* | 6/2002 | Buyaert | 166/255.3 |
| 2003/0047318 | A1 | 3/2003 | Cruickshank et al. | |
| 2005/0229805 | A1* | 10/2005 | Myers et al. | 102/275 |
| 2005/0252688 | A1 | 11/2005 | Head et al. | |
| 2005/0257930 | A1 | 11/2005 | Carter, Jr. et al. | |
| 2006/0207771 | A1 | 9/2006 | Rios, III et al. | |
| 2007/0034412 | A1* | 2/2007 | Forstner et al. | 175/320 |

OTHER PUBLICATIONS

Canadian Office Action for Application No. 2,597,966 dated May 12, 2009.

GB Examination Report for GB Application No. 0715075.8 dated Aug. 27, 2010.

* cited by examiner

METHOD AND APPARATUS FOR RETRIEVING AN ASSEMBLY FROM A WELLBORE

BACKGROUND OF THE INVENTION

1. Field of the Invention

Embodiments of the invention are related to retrieving an assembly from a wellbore. Embodiments of the invention are also related to the practice of sidetrack drilling for hydrocarbons using the assembly. The assembly may include a whipstock, a latch, and an anchor.

2. Description of the Related Art

Technology has been developed to allow an operator to drill a primarily vertical well and then drill an angled lateral borehole off of the vertical well. Generally, the vertical wellbore is first drilled and then reinforced with casing strings. The strings of casing are cemented into the wellbore. Cement is injected down the wellbore into the annular regions between the strings of casing and the surrounding formation. The combination of cement and casing strengthens the wellbore within the formation for the production of hydrocarbons.

It may be desirable to drill a lateral wellbore into production zones surrounding the formation by utilizing the casing of the vertical wellbore. In one instance, a tool known as a whipstock is positioned in the casing at a particular depth, such as above one or more producing zones. The whipstock is designed to direct a drilling operation into a side of the casing by deflecting a drill bit against the whipstock into the casing wall to create a window. After the window is created, the drill bit may be further run into the vertical well and urged through the window to form a new lateral wellbore in the desired direction. This process is sometimes referred to as sidetrack drilling.

Prior to forming the window and the lateral wellbore, an anchor is first set in the vertical wellbore at the desired depth. The anchor may act as a fixed body against which other downhole tools may be engaged to activate different tool operations. The anchor typically may be oriented in the desired direction of the lateral wellbore.

A whipstock is subsequently run into the wellbore and operatively connected to the anchor. The whipstock generally includes a deflection portion having a concave face. The deflection portion receives and directs the drill bit as it is urged downhole into the side of the casing. In this way, the window and lateral borehole may be formed at the desired depth and in the desired direction.

Once the lateral wellbore has been formed, traditionally, the sidetracking arrangement is set up to be retrieved in two trips. The first trip is made to retrieve the concave. A second trip is then made to retrieve the anchor, if the anchor is retrievable. The subsequent trips into and out of the wellbore increase the amount of time, and thus cost, to complete a sidetrack drilling operation. Some arrangements, however, utilize a permanent anchor that is left in the vertical wellbore and drilled through if necessary. Yet, if a second lateral wellbore is to be formed above or below the permanent anchor, the use of a second anchor is required.

Therefore, there is a need for an-assembly that can be used to reduce the number of trips necessary complete a wellbore operation, such as a sidetrack drilling operation. There is also a need for an improved method and apparatus for retrieving an assembly from a wellbore.

SUMMARY OF THE INVENTION

Embodiments of the invention generally relate to methods and apparatus for retrieving an assembly from a wellbore. In one embodiment, a method of retrieving an assembly having a whipstock coupled to an anchor from a wellbore may comprise the steps of releasing the whipstock from the anchor in the wellbore, re-engaging the whipstock to the anchor, and retrieving the whipstock with the anchor from the wellbore.

In one embodiment, a method of retrieving an assembly having a whipstock and an anchor from a wellbore during a single trip into the wellbore may comprise the steps of operating the assembly in the wellbore to retrieve the whipstock or to retrieve the whipstock with the anchor, and retrieving at least the whipstock from the wellbore.

In one embodiment, a method of retrieving an assembly during a single trip into a wellbore using a retrieval tool may comprise the step of lowering the retrieval tool in the wellbore to retrieve the assembly. The assembly may comprise a whipstock and an anchor. The method may further comprise the steps of releasing the anchor from engagement with the wellbore using the retrieval tool, and retrieving the whipstock and the anchor from the wellbore in the single trip into the wellbore.

In one embodiment, a method of retrieving an anchor from a wellbore may comprise the steps of engaging the anchor with a latch, disengaging the latch from the anchor, re-engaging the anchor with the latch and unsetting the anchor, and retrieving the anchor with the latch from the wellbore.

In one embodiment, a method of operating an assembly having a whipstock and an anchor in a wellbore may comprise the step of setting the assembly in the wellbore. The assembly may further comprise a disconnection member and a reconnection member between the whipstock and the anchor. The method may further comprise the steps of operating the disconnection member to separate the whipstock from the anchor, and retrieving at least the whipstock from the wellbore.

In one embodiment, a method of operating an assembly having a whipstock and an anchor in a wellbore may comprise the step of setting the assembly in the wellbore. The whipstock may be releasably connected to the anchor in a first configuration and the whipstock may be locked to the anchor in a second configuration. The method may further comprise the steps of releasing the whipstock from the anchor using a retrieval tool, and retrieving at least the whipstock from the wellbore.

In one embodiment, a method of using an assembly having an anchor and a whipstock in a wellbore may comprise the steps of positioning the anchor in the wellbore, positioning the whipstock in the wellbore, and operating the assembly to enable retrieval of the whipstock with the anchor. The positioning of the whipstock and the operating of the assembly may be performed in a first trip into the wellbore.

In one embodiment, an apparatus for selectively retrieving an anchor from a wellbore may comprise a body, a setting member disposed around the body and adapted to engage the anchor, and a retrieving member disposed around the body and adapted to selectively retrieve the anchor from the wellbore.

In one embodiment, a sidetrack drilling apparatus for use in a wellbore may comprise an assembly having a whipstock and an anchor. The whipstock may be releasably connected to the anchor in a first configuration and the whipstock may be locked to the anchor in a second configuration.

In one embodiment, a sidetrack drilling apparatus for use in a wellbore may comprise a whipstock, a latch coupled to the whipstock, and an anchor. The anchor may be operable to be selectively retrieved from the wellbore using the latch.

BRIEF DESCRIPTION OF THE DRAWINGS

So that the manner in which the above recited features of the invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

The invention generally relates to an apparatus and method of retrieving an assembly from a wellbore. As set forth herein, the assembly will be described as it relates to downhole tools such as an anchor, a latch, and a whipstock. It is to be noted, however, that embodiments of the invention are not limited to use with such tools, but may be equally applicable to use with other types of wellbore tools. Further, as set forth herein, the assembly will be described as is relates to side track drilling operations. It is to be noted, however, that embodiments of the invention are not limited to use with side track drilling operation, but may be equally applicable to use with other types of wellbore operations.

Figure 1A:
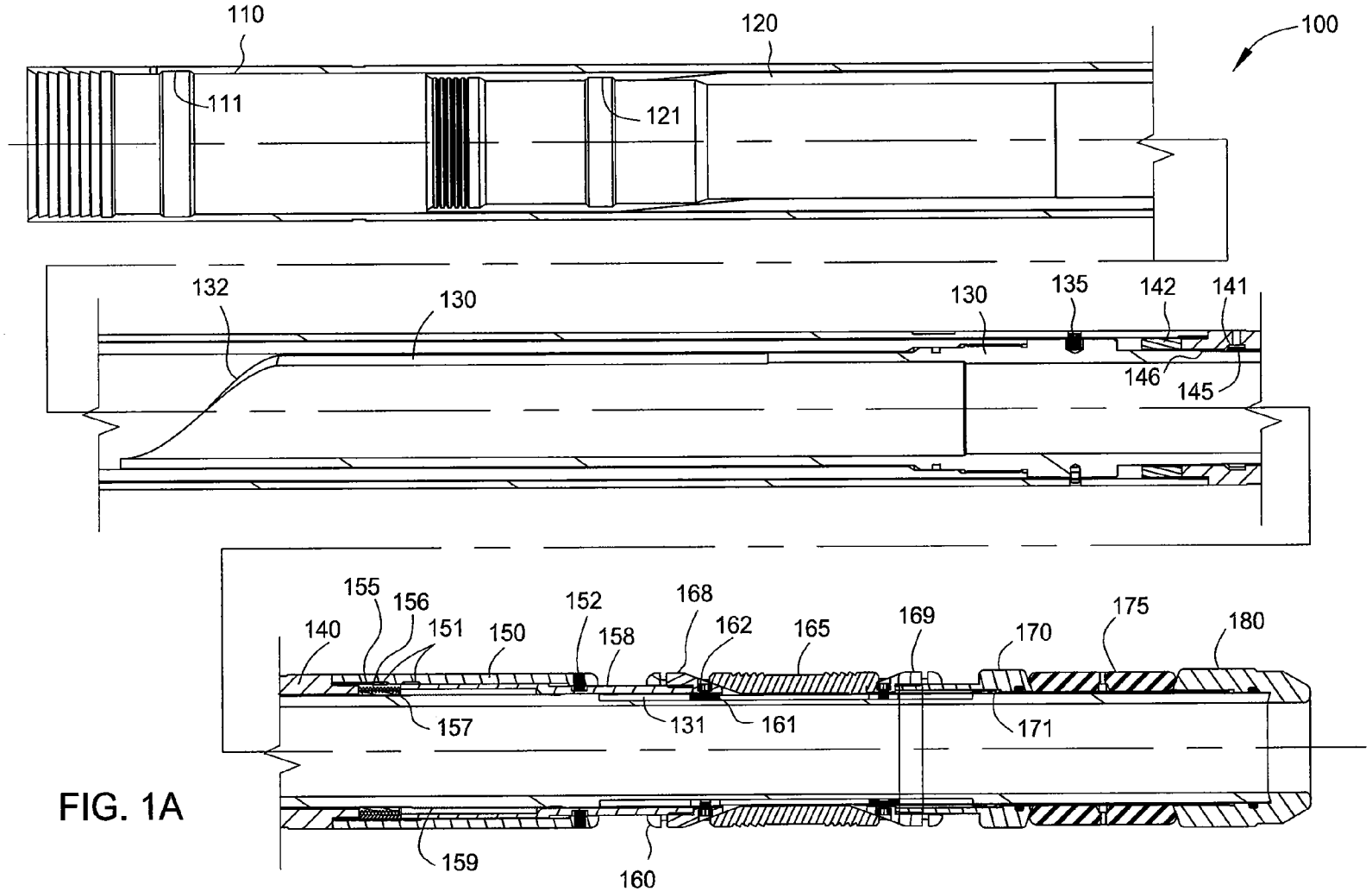
FIG. 1A is a cross-sectional view of an anchor according to one embodiment of the present invention.

FIG. 1A shows a cross-sectional view of an anchor 100 according to one embodiment of the present invention. The anchor 100 may include a retrieval sleeve 110, a setting sleeve 120, and an inner mandrel 130. The retrieval sleeve 110 may include a cylindrical body that surrounds the setting sleeve 120 and surrounds part of the inner mandrel 130. The retrieval sleeve 110 may also be releaseably connected to the inner mandrel 130 by a shearable member, such as setting shear screws 135. The inner surface of the retrieval sleeve 110 may include a recess 111 adapted to assist with the selective retrieval of the anchor 100 from a wellbore.

The setting sleeve 120 may include a cylindrical body that partially surrounds and is threadedly connected to the inner mandrel 130. The inner surface of the setting sleeve 120 may include a recess 121 adapted to assist with the setting of the anchor 100 in the wellbore and facilitate a wellbore operation, such as a sidetrack drilling operation. The setting sleeve 120 and the inner mandrel 130 may be slideably disposed in the retrieval sleeve 110 upon release of the setting shear screws 135 between the retrieval sleeve 110 and the inner mandrel 130. The lower end of the setting sleeve 120 may abut a shoulder formed on the outer surface of the inner mandrel 130 where the setting sear screws 135 may be disposed.

An orientation cut 132 may be formed on the top end of the inner mandrel 130. The orientation cut 132 may include a machined helical groove. The orientation cut 132 may be used to help orient, for example, a latch and a whipstock as they engage with the anchor 100 to conduct the drilling operation in the desired direction and location.

The lower end of the retrieval sleeve 110 may be threadedly connected to a first support member 140. Adjacent to the first support member 140 and surrounded by the retrieval sleeve 110 may be a spacer 142 that surrounds part of the inner mandrel 130. The spacer 142 may include a cylindrical body and may be disposed between the first support member 140 and the shoulder formed on the outer surface of the inner mandrel 130 where the setting shear screws 135 may be disposed. The spacer 142 may prevent the shoulder of the inner mandrel 130 from abutting against the first support member 140 and may be used to help facilitate retrieval of the anchor 100.

The first support member 140 may include a cylindrical body that surrounds part of the inner mandrel 130. The first support member 140 may include a recess 141 on its inner surface in which a support ring 145 may be disposed. The support ring 145 may include a cylindrical body that surrounds part of the inner mandrel 130. As the inner mandrel 130 slides longitudinally relative to the first support member 140, the support ring 145 is retained within the recess 141 so that the inner mandrel 130 also slides relative to the support ring 145. The inner surface of the support ring 145 may include teeth that are adapted to mate with a first set of teeth 146 disposed on the outer surface of the inner mandrel 130 to help retain the relative position between the inner mandrel 130 and the first support member 140 during retrieval of the anchor 100. The first set of teeth 146 may be positioned relative to the support ring 145 so that they mate with the teeth on the support ring 145 during retrieval of the anchor 100.

The lower end of the first support member 140 may be threadedly connected to an upper end of a release sleeve 150. The lower end of the release sleeve 150 may be releaseably connected to a second support member 158. The release sleeve 150 may include a cylindrical body that surrounds part of the inner mandrel 130 and part of the second support member 158. Recesses 151 may be disposed along the inner surface of the release sleeve 150 to disengage a lock ring 155, which is slideably disposed between the release sleeve 150, the inner mandrel 130, the first support member 140, and the second support member 158. The lock ring 155 may include an outer ring 156 with shoulders disposed along its outer surface that are adapted to engage with the recesses 151 on the inner surface of the release sleeve 150; the inner surface of the outer ring 156 may include teeth that are adapted to engage with teeth disposed on the outer surface of an inner ring 157. The inner surface of the inner ring 157 may also include teeth that are adapted to engage with a second set of teeth 159 disposed along the outer surface of the inner mandrel 130. The outer ring 156 and inner ring 157 may be adapted to lock with each other, and the teeth on the inner ring 157 may be adapted to engage with the second set of teeth 159 on the inner mandrel 130, to help facilitate setting of the anchor 100. During retrieval of the anchor 100, the outer ring 156 and inner ring 157 may be adapted to unlock, when the shoulders on the outer ring 156 engage with the recesses 151 on the inner surface of the release sleeve 150, to help facilitate retrieval of the anchor 100.

The second support member 158 may be releaseably connected to the release sleeve 150 by retrieval shear screws 152. The second support member 158 may include a cylindrical body that surrounds part of the inner mandrel 130. Upon release of the retrieval shear screws 152, a shoulder on the outer surface of the second support member may be adapted to engage with a shoulder on the inner surface of the release sleeve 150 to help facilitate retrieval of the anchor 100.

The lower end of the second support member 158 may be surrounded by a housing 160. The housing 160 may include a cylindrical body that also surrounds part of the inner mandrel 130 and may have large openings arranged around the body of the housing. A first cone 168, a second cone 169, and slips 165 may be positioned in the openings of the housing. The cones 168 and 169 may include cylindrical bodies with tapered shoulders along the outer surfaces of the cones. The cones 168 and 169 may be seated within and at the ends of the housing 160 so that the tapered shoulders project through the openings of the housing. The cones 168 and 169 may be slideable towards each other relative to the housing 160. The slips 165 may include horizontally and vertically positioned teeth, relative to the wellbore, along the outer surfaces of the slips to engage with the wellbore. When the anchor 100 is set, the horizontal teeth may be adapted to resist axial loads exerted on the anchor and the vertical teeth may be adapted to resist torque loads exerted on the anchor, during the wellbore operation. The slips 165 may be positioned in the openings of the housing 160, and may further include recesses (not shown) adapted to engage with shoulders (not shown) disposed on the inner surfaces of the opening of the housing 160 to longitudinally fix the slips relative to the housing. The inner surface of the slips 165 may include tapered surfaces to slideably engage with the tapered shoulders on the cones 168 and 169. As the cones 168 and 169 are directed towards each other, the slips 165 are projected outward when the tapered surfaces of the slips travel up the tapered shoulders of the cones. The slips 165 may also include springs or bands (not shown) circumferentially positioned within the body of the slips, such that as the slips are radially expanded outward, the springs or bands provide a reaction force adapted to retract the slips to a non-expanded position. The number of openings in the housing 160 and the number of slips positioned in the housing 160 may vary.

Slots 131 may be formed on the outer surface of the inner mandrel 130 adjacent to the cones 168, 169 and slips 165. The slots 131 may be adapted to receive keys 161, which may be slideably disposed in the slots 131. The keys 161 may be retained in the slots 131 by cones 168, 169 with bolts 162. The bolts 162 may be seated through cones 168,169 and engage with the keys 161. As the cones slide within the housing 160, the keys 161 slide within the slots 131. The bolt/key arrangement may be used to help resist torque exerted on the anchor 100, specifically the inner mandrel 130, the housing 160, cones 168, 169, and slips 165. The torque may be held and evenly distributed through the cones 168, 169.

In an alternative embodiment, a first slot may be formed on outer surface of the inner mandrel 130 below the first cone 168, a second slot may be formed on the inner surface of the first cone 168, and a third slot may be formed on the inner surface of the second support member 158. A long key may be disposed within the three slots so that the second support member 158 and the first cone 168 may slide relative to the key but are rotationally fixed relative to the inner mandrel 130. The three slot/long key arrangement may be used to help resist torque exerted on the anchor 100, specifically the inner mandrel 130, the housing 160, cones 168, 169, slips 165, and second support member 158. The depths of the slots on each component may be minimal since the long key may engage a larger contact area among the three components.

In an alternative embodiment, a first slot may be formed on the inner mandrel 130, below cone 168 or 169 and between the openings of the housing 160. A second slot may be formed on the inner surface of the housing 160 between the openings, adjacent the first slot. A key may be disposed in the first and second slots so that the inner mandrel 130 may slide relative to the housing 160, but the housing 160 and the inner mandrel may not rotate relative to each other. The two slot/key arrangement may be used to help resist torque exerted on the anchor 100, specifically the inner mandrel 130, the housing 160, and slips 165. The torque may be held through the housing 160 and evenly distributed from the slips 165, which includes a short load path, i.e. the slips 165 to the housing 160 to the inner mandrel 130 and vice versa.

Referring back to FIG. 1A, the first cone 168 is connected to the lower end of the second support member 158. The second cone 169 is connected to the upper end of a gage 170. The gage 170 may include a cylindrical body that surrounds part of the inner mandrel 130. The gage 170 and the inner mandrel 130 may be slideable relative to each other. A gage support 171 may be positioned between the gage 170 and the inner mandrel 130 and may be seated in a recess on the outer surface of the inner mandrel 130 so that it projects above the recess. The gage support 171 may include a cylindrical body that surrounds part of the inner mandrel 130, and it may be adapted to engage a shoulder on the inner surface of the gage 170. The gage support 171 may be used to help facilitate removal of the anchor 100 from the wellbore.

The lower end of the gage 170 may include a flanged section that abuts a packing element 175. The flanged section of the gage 170 may help compress the packing element 175 to allow the element to engage and seal against the wellbore. The packing element 175 may include an elastomeric material that surrounds part of the inner mandrel 130. The packing element 175 may abut a bottom sub 180 on its opposite side. The bottom sub 180 may include a cylindrical body that may be threadedly connected to the lower end of the inner mandrel 130. O-rings may be used to seal the gage ring/inner mandrel and bottom sub/inner mandrel interfaces. As the inner mandrel 130 is pulled in an upward direction, the packing element 175 may be compressed between the bottom sub 180 and the gage 170 to engage and seal against the wellbore.

Figure 1B:
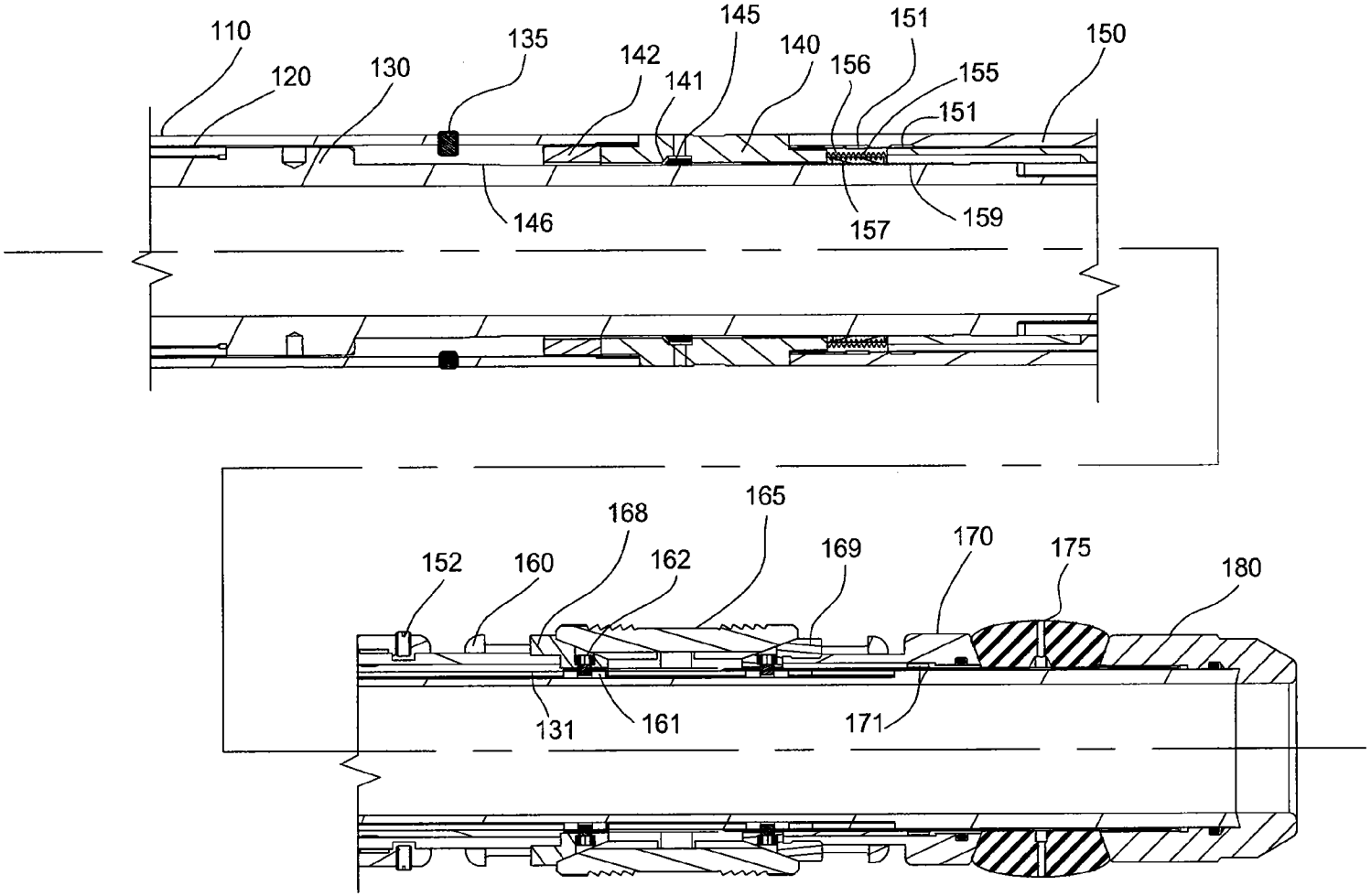
FIG. 1B shows the set position of the anchor.

FIG. 1B shows the set position of the anchor 100. When the anchor 100 is lowered into the wellbore to the desired location, a pull force may be applied to the inner mandrel 130 and/or a push force may be applied to the retrieval sleeve 110. These forces may create enough shear force to shear the setting shear screws 135 and release the retrieval sleeve 110 from the inner mandrel 130, thereby allowing the inner mandrel 130 and retrieval sleeve 110 to slide relative to each other.

The anchor 100 may be set by numerous setting tools known in the art. In one embodiment, the anchor 100 may be lowered on coiled tubing. In another embodiment, the anchor 100 may be lowered on coiled tubing, along with a whipstock and latch assembly (further described below). The anchor 100 may be actuated by applying a pull force to the tubing to set the packing element 175, as described above. In an alternative embodiment, the anchor 100 may be lowered on coiled tubing, along with a whipstock and latch assembly (further described below), and hydraulically actuated to set the packing element 175. Under the embodiments discussed above, a wellbore operation, such as a sidetrack drilling operation may commence after the anchor 100, the whipstock and the latch are positioned in the wellbore. Upon completion of the wellbore operation, the whipstock and the latch and/or the anchor 100 may be retrieved from the wellbore in a single trip into a wellbore.

Referring back to FIG. 1B, as the inner mandrel 130 is pulled in an upward direction, the second set of teeth 159 on the outer surface of the inner mandrel may engage with the teeth on the inner surface of the inner ring 157 of the lock ring 155. This engagement may help prevent the inner mandrel 130 from sliding back into a downward direction, as the lock ring 155 is held in position by the retrieval sleeve 110/first support member 140/release sleeve 150/second support member 158 connection.

As the inner mandrel 130 is pulled in an upward direction, the bottom sub 180 may also be directed in the upward direction to compress the packing element 175 between the bottom sub and the gage 170. The retrieval sleeve 110 may be directed in a downward direction, which may direct the first support member 140, release sleeve 150, and second support member 158 in a downward direction. The second support member 158 may direct the first cone 168 towards the second cone 169 so that the slips 165 travel up the tapered shoulders on the cones and project outward to engage the wellbore. From the opposite side, the gage 170 may direct the second cone 169 towards the first cone 168 so that the slips 165 travel up the tapered shoulders on the cones and project outward to engage the wellbore. As the slips 165 are set, the keys 161 attached to the cones 168, 169 may slide within the slot 131 of the inner mandrel 130 to help resist any torque directed to the anchor 100 during the drilling operation.

Figure 2A:
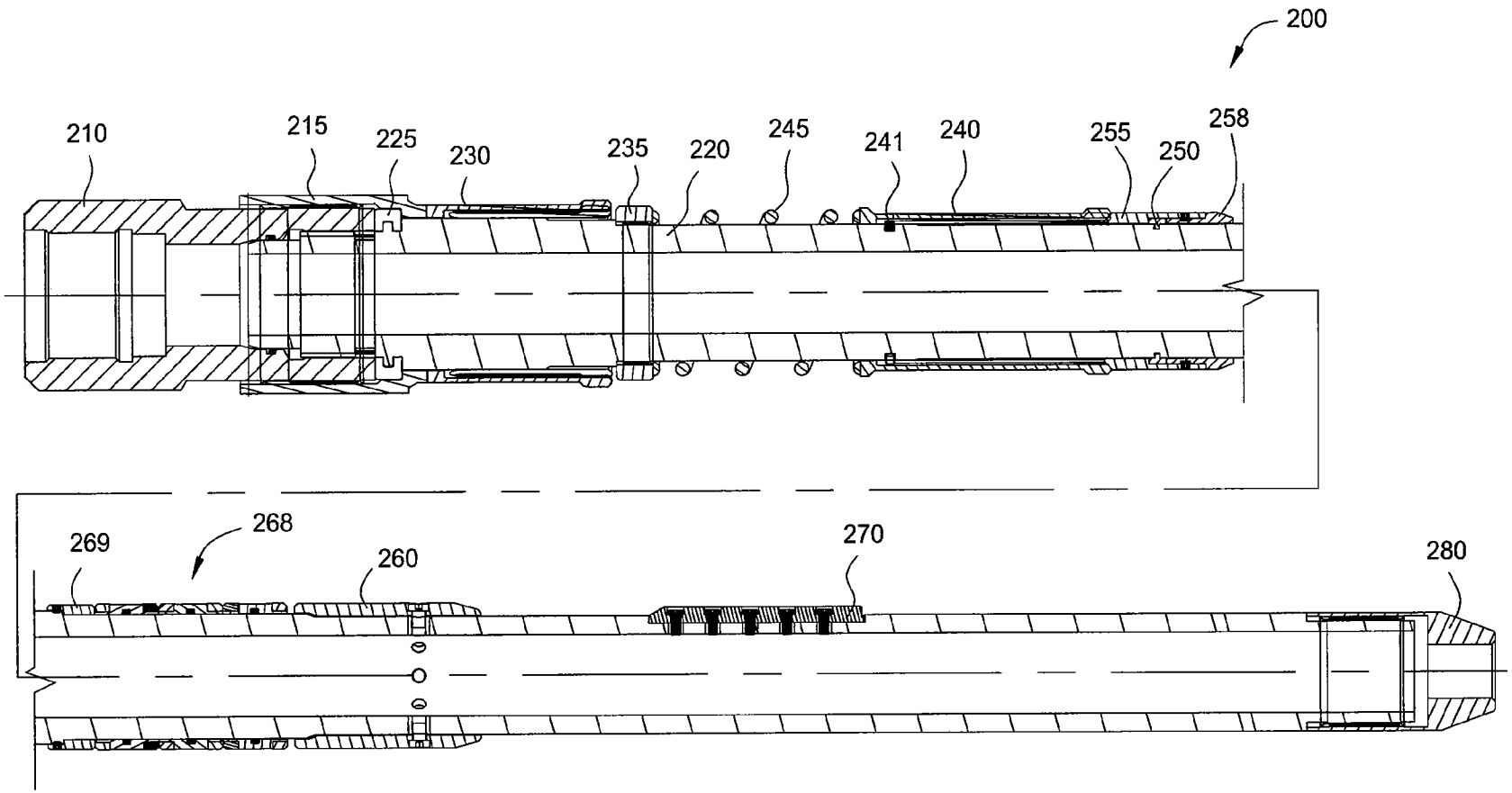
FIG. 2A is a cross-sectional view of a latch according to one embodiment of the present invention.
Figure 6:
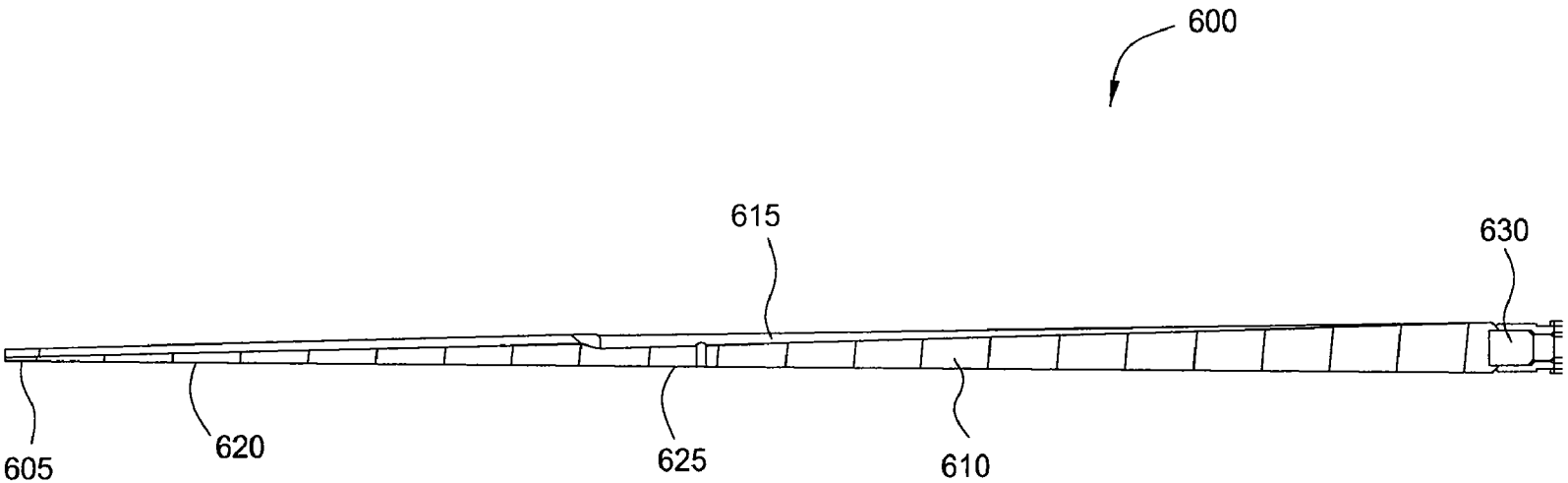
FIG. 6 is a cross sectional view of a whipstock according to one embodiment of the present invention.

After the anchor 100 is set, a whipstock 600 (as shown in FIG. 6) and a latch 200 (as shown in FIG. 2A) may engage with the anchor 100 to conduct the drilling operation. After the drilling operation is completed, the whipstock 600 and the latch 200 may be disengaged from the anchor 100 and retrieved from the wellbore. The anchor 100 is adapted to be selectively retrievable, along with the whipstock 600 and the latch 200 in one trip into the wellbore.

Figure 1C:
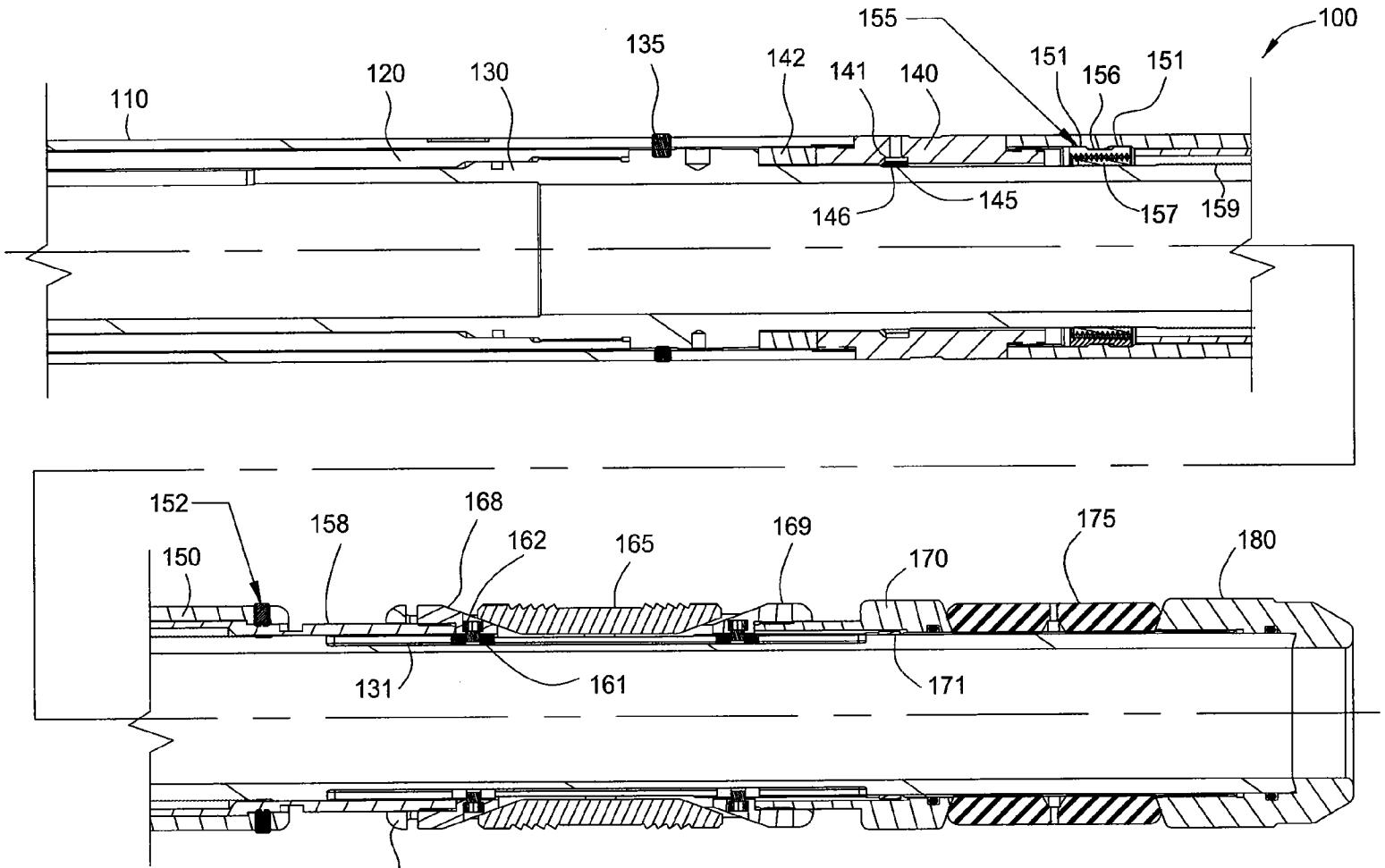
FIG. 1C shows the retrieval position of the anchor.

FIG. 1C shows the retrieval position of the anchor 100. The recess 111 along the inner surface of the retrieval sleeve 110 may be engaged to retrieve the anchor 100. A pull force may be applied to the retrieval sleeve 110 to shear the retrieval shear screws 152 and release the release sleeve 150 from the second support member 158. The release sleeve 150 may then be directed in an upward direction so that the recesses 151 along its inner surface engage the shoulders on the outer surface of the outer ring 156 of the lock ring 155. This engagement may allow the outer ring 156 to expand outward and disengage from the inner ring 157. In turn, the teeth on the inner surface of the inner ring 157 disengage from the second set of teeth 159 on the inner mandrel 130. The disengagement between the inner mandrel 130 and the lock ring 155 allows unsetting of the anchor 100.

Upon disengagement of the inner mandrel 130 and the lock ring 155, the slips 165 may be retracted by the reaction force provided by the springs or bands disposed within the body of the slips 165, thereby allowing the first cone 168 and the second cone 169 to move away from each other. Also, the inner mandrel 130 may be directed in a downward direction so that the bottom sub 180 moves away from the gage 170 and relieves the compression of the packing element 175. At which point, the gage 170 may be directed in a downward direction, via the gage support 171. The gage 170 may also retract the second cone 169 from the first cone 168 so that the slips 165 retract from engagement with the wellbore. As the retrieval sleeve 110 is directed in an upward direction, the second support member 158 engages a shoulder on the inner surface of the release sleeve 150 (since the retrieval shear screws 152 have been sheared) and may be directed in an upward direction, via the retrieval sleeve 110/first support member 140/release sleeve 150 connection. The second support member 158 may also retract the first cone 168 from the second cone 169 so that the slips 165 retract from engagement with the wellbore. Finally, the first set of teeth 146 on outer surface of the inner mandrel 130 may engage the teeth on the inner surface of the support ring 145 to help prevent the inner mandrel 130 from being directed back in an upward direction relative to the retrieval sleeve 110 during removal of the anchor 100.

After the packing element 175 and the slips 165 are disengaged from the wellbore, the anchor 100 may be removed from the wellbore, along with the whipstock and the latch. The decision to selectively remove the anchor 100 may be made while the retrieving tool is down in the wellbore. The latch and whipstock may be disengaged from the anchor 100 and removed, or they may be disengaged from the anchor and selectively re-engaged to the anchor 100 to selectively remove all three components from the wellbore.

FIG. 2A shows a cross-sectional view of the latch 200 according to one embodiment of the present invention. The latch 200 may include a top sub 210 that may be adapted receive a whipstock (not shown) at its upper end. A lower portion of the top sub 210 may be adapted to receive the upper end of a latch mandrel 220. The latch mandrel 220 may include a cylindrical body with a longitudinal bore disposed through the body. The interconnection between the top sub 210 and the latch mandrel 220 may include a splined connection to help adjust the orientation of a key 270 (more fully discussed below) and thus the latch 200 relative to the whipstock. By utilizing a splined connection, orientation of the latch and the whipstock may not be required when initially setting the anchor (not shown) in the wellbore. An o-ring may be used to seal a top sub 210/latch mandrel 220 interface.

A split ring 225 with a u-shaped inner profile surrounds a corresponding lip on the outer surface of the latch mandrel 220, adjacent to the top sub 210 and latch mandrel 220 interconnection. The top sub 210 may abut the split ring 225 on one side and a shoulder of the latch mandrel 220 may abut the split ring 225 on the other side, but the split ring 225 may partially extend beyond the shoulder of the latch mandrel. The split ring 225 may help secure the top sub 210 to the latch mandrel 220 with the addition of a top sleeve 215. At one end, the top sleeve 215 may threadedly connect to and surround part of the outer surface of the top sub 210. At the other end, the top sleeve 215 may surround part of the outer surface of the shoulder of the latch mandrel 220. A shoulder may be disposed along the inner surface of the top sleeve 215 to seat against the partially extended portion of the split ring 225. As the top sleeve 215 is threaded to the top sub 210, the top sub 210 and the split ring 225, which surrounds the lip on the latch mandrel 220, may be pressed together to secure the top sub 210 to the latch mandrel 220.

A retrieving member 230 is slideably disposed around the latch mandrel 220. The retrieving member 230 may be used to reconnect the latch 200 to the anchor 100, as will be described herein. The retrieving member 230 may include a collet. The collet 230 abuts the top sleeve 215 at one end. At the other end, the collet 230 may include outwardly projecting fingers. Adjacent to the fingers on the collet 230, a ramp 235 may be used to urge the fingers in an outward direction when the ramp 235 and the collet 235 are forced together. The ramp 235 may include a cylindrical body disposed around the latch mandrel 220. In an alternative embodiment, the ramp 235 may be a snap ring disposed on a shoulder of the latch mandrel 220.

A setting member 240 may be slideably disposed around the latch mandrel 220. The setting member 240 may be used to disconnect the latch 200 from the anchor 100, as will be described herein. The setting member 240 may include a collet. The collet 240 abuts a biasing member 245 at one end. The biasing member 245 may include a spring disposed around the latch mandrel 220 between the ramp 235 and the collet 240. At the other end, the collet 240 may include outwardly projecting fingers. Adjacent to the fingers on the collet 240, an upper shear ring housing 255 may be used to urge the fingers in an outward direction when the housing and the collet 240 are forced together. A snap ring 241 disposed on the latch mandrel 220 may engage the collet 240 to deflect the fingers from the outward direction to a retracted position.

In one embodiment, the retrieving member 230 and the setting member 240 may be separate components. In an alternative embodiment, the retrieving member 230 and the setting member 240 may be an integral component. In an alternative embodiment, either the retrieving member 230 or the setting member 240 may be configured to act as both the setting and retrieving component. For example, the setting member 240 may be adapted to initially by-pass the retrieval sleeve 110, engage the setting sleeve 120, release engagement from the setting sleeve 120, and then selectively engage the retrieval sleeve 110 to retrieve the anchor 100. Features of both the retrieving member 230 and the setting member 240 may be combined to form a single setting/retrieving component.

The upper shear ring housing 255 may include a cylindrical body with a partially recessed inner surface disposed around the latch mandrel 220. A lower shear ring housing 258 may include a cylindrical body with a partially recessed outer surface disposed around the latch mandrel 220. The recessed portions of the two housings may be connected together and used to enclose a shear ring 250. The shear ring 250 may include a cylindrical body with a notch projecting from its inner surface. The shear ring 250 may be disposed around the latch mandrel 220 so that the notch engages with a groove on the outer surface of the latch mandrel 220 to longitudinally fix the shear ring to the mandrel.

A landing sleeve 260 may be disposed around and connected to the latch mandrel 220. The landing sleeve 260 may include a cylindrical body that is positioned adjacent a seal assembly 268. The outer diameter of the landing sleeve 260 may be dimensioned to help provide a smooth landing of the latch 200. The landing sleeve may be used to help land the latch 200 and protect the seal assembly 268 from damage that may be caused when the latch 200 is being set. The seal assembly 268 may include a plurality of bonded seals disposed around the latch mandrel 220. The bonded seals may include cylindrical metallic bodies surrounded by elastomeric seals at their ends. Along the inner surfaces of the metallic bodies, o-rings may be used to seal the interface between the metallic bodies and the latch mandrel 220. A retaining member 269 may be used to retain the seal assembly along the latch mandrel 220. The retaining member 269 may include a cylindrical body with partially recessed inner surface disposed around and connected to the latch mandrel 220.

A key 270 may be disposed on and connected to the outer surface of the latch mandrel 220 adjacent the landing sleeve 260. The key 270 may include a generally rectangular body having a portion protruding out of the outer surface of the latch mandrel 220. The key 270 may be used to help orient the latch 200 when it engages the orientation cut 132 on the anchor 100 as shown in FIG. 1A. The key 270 may also be used to resist any torque exerted on the latch 200 once it is set in the anchor.

Finally, a latch guide 280 may be connected to the end of the latch mandrel 220 to help guide the latch 200 as it is lowered into a wellbore. The latch guide 280 may include a cylindrical body that is threadedly connected to the latch mandrel 220. The latch guide 280 may also include cone-shaped nose projecting from the end of the latch mandrel 220.

Figure 2B:
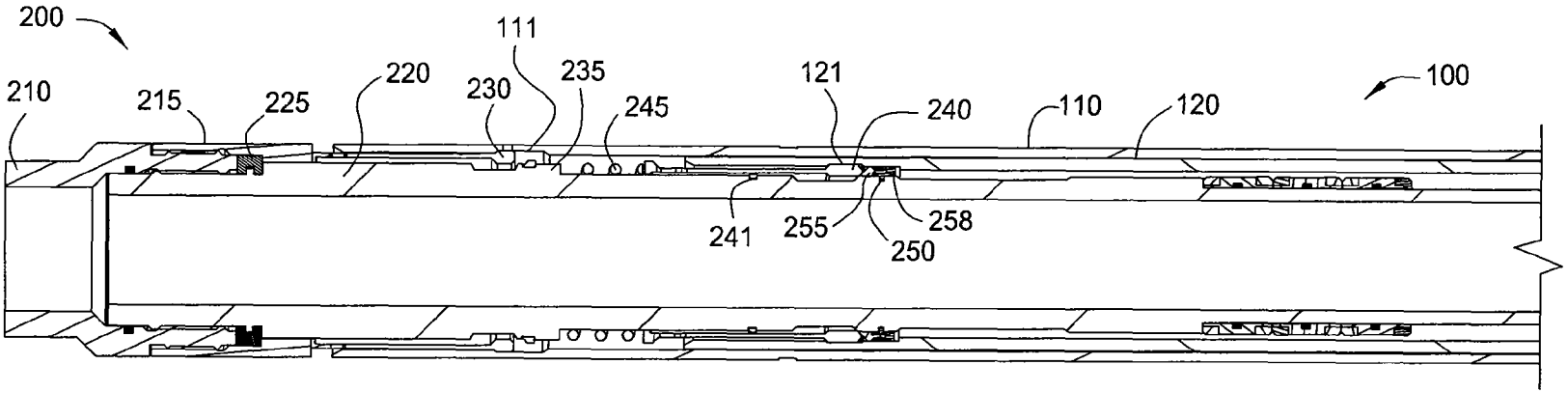
FIG. 2B shows the run-in/setting position of the latch with the anchor.
Figure 2C:
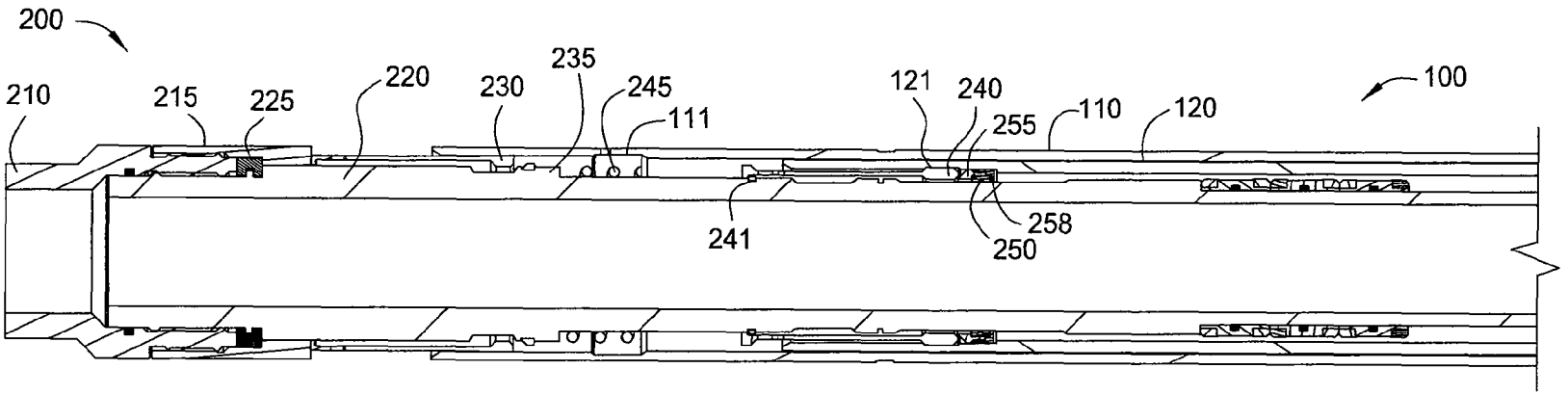
FIG. 2C shows the disengaged position of the latch from the anchor.
Figure 2D:
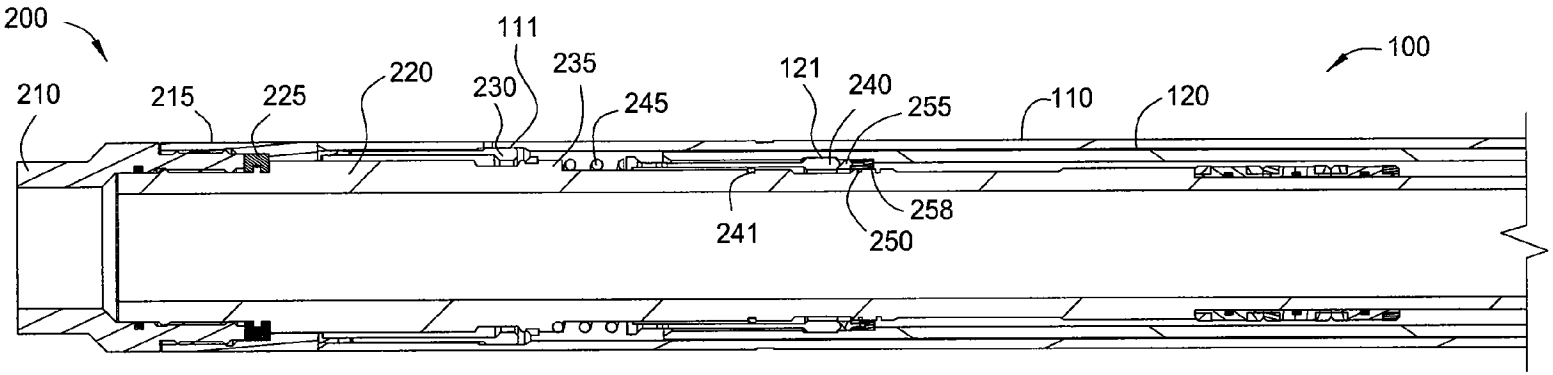
FIG. 2D shows the re-engaged position of the latch with the anchor.
Figure 2E:
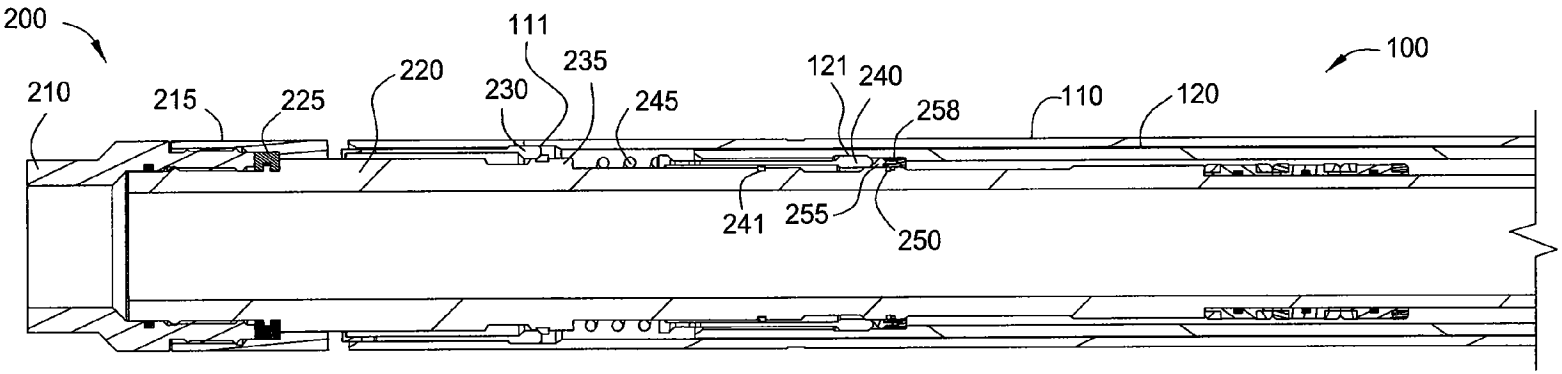
FIG. 2E shows the retrieval position of the latch and the anchor.

FIGS. 2B-2E show the operation of the latch 200 with respect to the anchor 100. FIGS. 2B-2C show the latch 200 as it engages and disengages from the anchor 100. FIGS. 2D-2E show the latch 200 as it selectively re-engages with the anchor 100 to unset and remove it from the wellbore. The same reference numerals relating to the anchor 100 will be used in FIGS. 2B-2E.

After the anchor 100 is set in the wellbore, the latch 200 may be lowered into the wellbore to engage the anchor 100. The latch guide 280 may be used to help guide the latch 200 as it is lowered toward the anchor 100. As the latch 200 is introduced into the anchor 100, the key 270 of the latch may engage with the orientation cut 132 on the inner mandrel 130 of the anchor to orient and align the latch relative to the anchor, before the seal assembly 268 of the latch seals with the setting sleeve 120 of the anchor. The outer diameter of the landing sleeve 260 of the latch may be dimensioned to have a small clearance with respect to the inner diameter of the setting sleeve 120 of the anchor 100. The landing sleeve may be used to help land the latch in the anchor to protect the seal assembly 268 from damage that may be caused when the latch is introduced into the anchor.

FIG. 2B shows the run-in/setting position of the latch 200 as it engages with the anchor 100. The shear ring 250 and shear ring housings 255 and 258 may land on a shoulder disposed along the inner surface of the setting sleeve 120. The setting member 240 may also engage the recess 121 along the inner surface of the setting sleeve 120 to connect the setting member 240 to the setting sleeve 120. At this point, the retrieving member 230 does not engage with the recess 111 disposed along the inner surface of the retrieval sleeve 110. The biasing member 245 compresses until it produces enough force to help the setting member 240 engage the recess 121 on the setting sleeve 120. The biasing member 245 may also be used to abut the setting member 240 against the upper shear ring housing 255 to prevent any space between the two components because the housing may help engage the setting member 240 with the recess 121 on the setting sleeve 120.

Once the latch 200 is set in the anchor 100 and assuming a whipstock is connected to the top of the latch 200, the wellbore operation may commence. During the wellbore operation, the shear ring housings 255 and 258 and the setting member 240 keep the latch 200 engaged with the anchor 100. After the wellbore is complete, a pull force may be applied to the whipstock and thus the latch 200 to shear the shear ring 250.

FIG. 2C shows the disengaged position of the latch 200 from the anchor 100. When the shear ring 250 shears, the latch mandrel 220 may be pulled in an upward direction relative to the setting member 240 until the snap ring 241 engages the setting member 240 and deflects the fingers out of the recess 121 on the setting sleeve 120 of the anchor 100, thereby disconnecting the latch 200 from the anchor 100. This allows the latch 200 to disengage from the anchor 100 and be retrieved from the wellbore, along with the whipstock. The anchor 100 may then be selectively retrieved after the latch 200 is disengaged from the anchor 100 by re-engaging the latch 200 with the anchor and unsetting the anchor.

FIG. 2D shows the re-engaged position of the latch 200 with the anchor 100. To selectively retrieve the anchor 100, the latch 200 may subsequently be reintroduced into the anchor 100 to engage the retrieving member 230 with the retrieval sleeve 110, thereby reconnecting the latch 200 to the anchor 100. The retrieving member 230 may engage the recess 111 disposed along the inner surface of the retrieval sleeve 110 because the sheared shear ring 250 will not prevent the latch mandrel 220 from being further introduced into the anchor 100. The biasing member 245 compresses as the latch 200 is further introduced into the anchor 100. In addition, the top sleeve 215 may abut the retrieval sleeve 110 to prevent the latch 200 from being completely received through the anchor 100.

FIG. 2E shows the retrieval position of the latch 200 and the anchor 100. After the latch 200 is re-engaged with the anchor 100, i.e. when the fingers on the retrieving member 230 engage the recess 111 on the inner surface of the retrieval sleeve 110, the latch 200 may be pulled in an upward direction to remove the latch and the anchor. As the latch is pulled upward, the ramp 235 may abut the retrieving member 230 to help keep the fingers engaged with the recess 111 of the retrieval sleeve 110, thereby locking the latch 200 to the anchor 100 to prevent disengagement therebetween as they are removed from the wellbore. The pull force applied to the latch 200 and thus the anchor 100 may then be directed to unset the anchor from the wellbore, via the retrieval sleeve 110 as discussed above with respect to FIG. 1C. Once the anchor 100 is unset, the tools may then be removed from the wellbore in one trip.

Figure 3A:
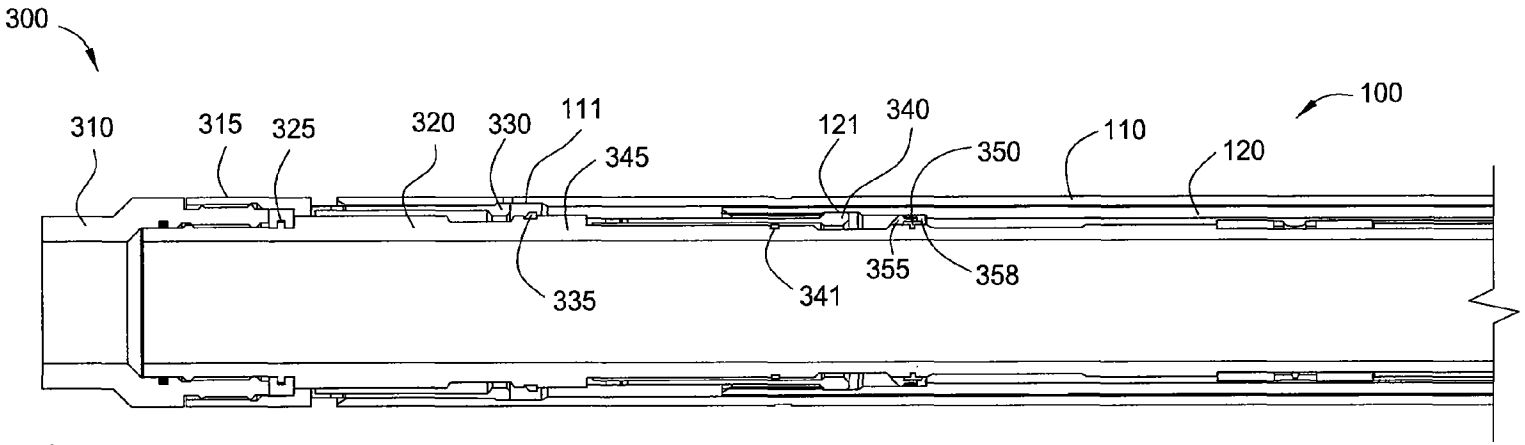
FIG. 3A is a cross-sectional view of a latch according to one embodiment of the present invention.

FIG. 3A shows a cross-sectional view of a latch 300 according to one embodiment of the present invention. The figure also shows the run-in position of the latch 300 as it is introduced into the anchor 100 and includes the same reference numerals with respect to the anchor 100. The latch 300 may include many of the same components as the latch 200 described above; these same components are identified with the same ending reference numerals as the latch 200 but will range in the 300's. The latch 300 may also operate in a substantially similar way as the latch 200.

The main differences between the latch 300 and the latch 200 are the use of a shoulder 345 and a snap ring 335, instead of the biasing member 245 and the ramp 235. The shoulder 345 may be formed from the latch mandrel 320 and may abut the setting member 340. The snap ring 335 may be disposed on the shoulder 345 and may be adapted to engage the retrieving member 330.

Figure 3B:
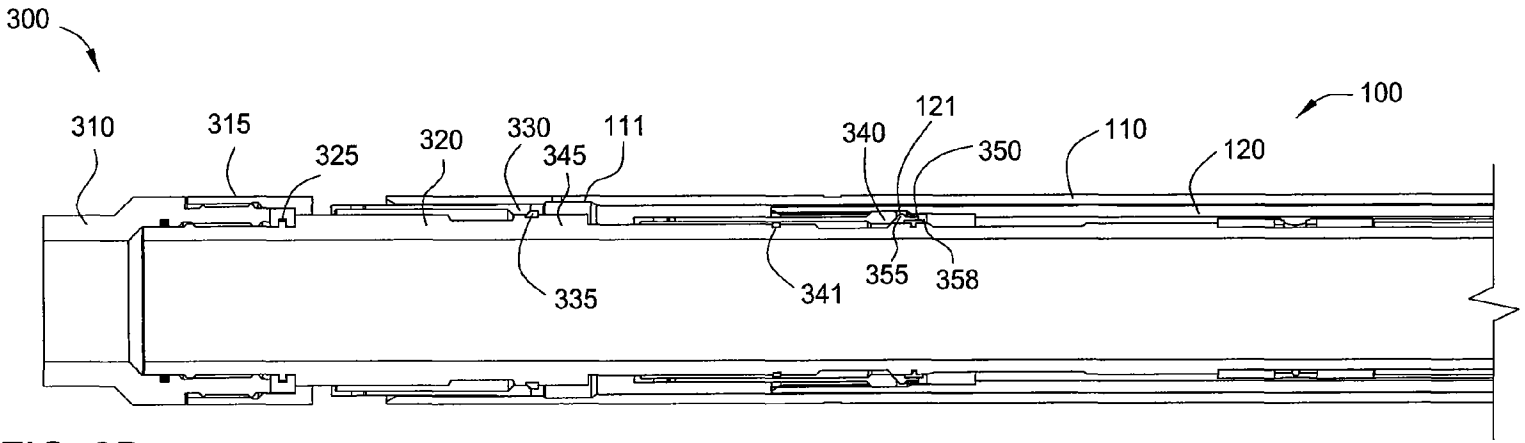
FIG. 3B shows the run-in/setting position of the latch with the anchor.
Figure 3C:
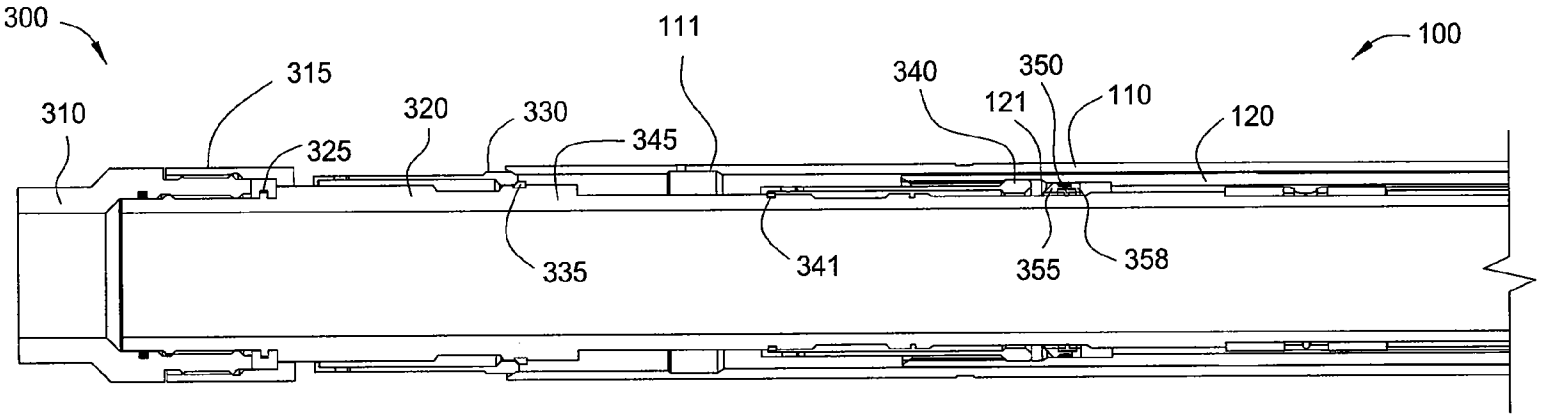
FIG. 3C shows the disengaged position of the latch from the anchor.
Figure 3D:
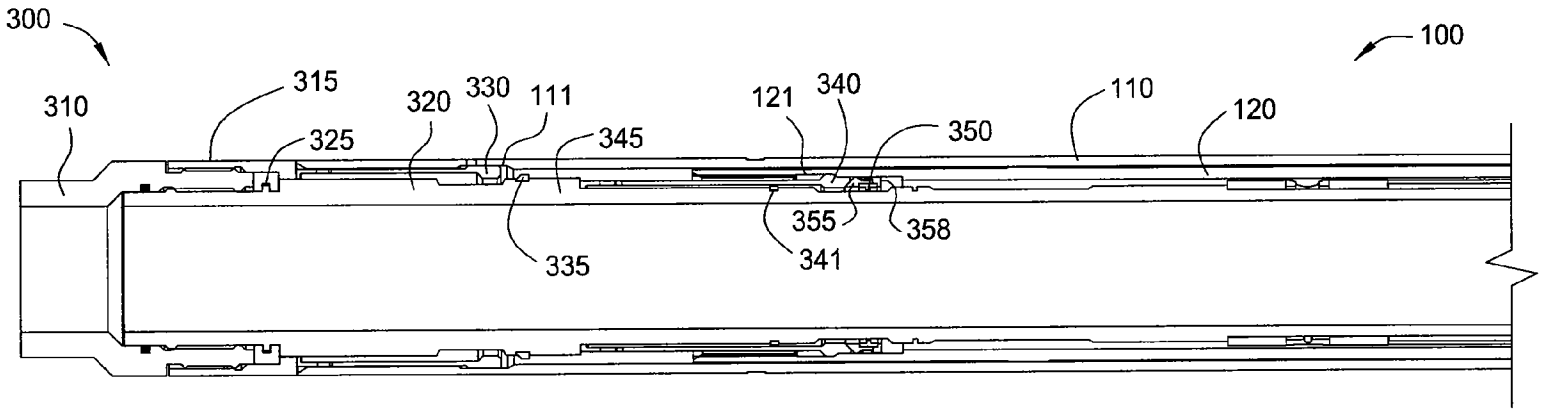
FIG. 3D shows the re-engaged--position of the latch with the anchor.
Figure 3E:
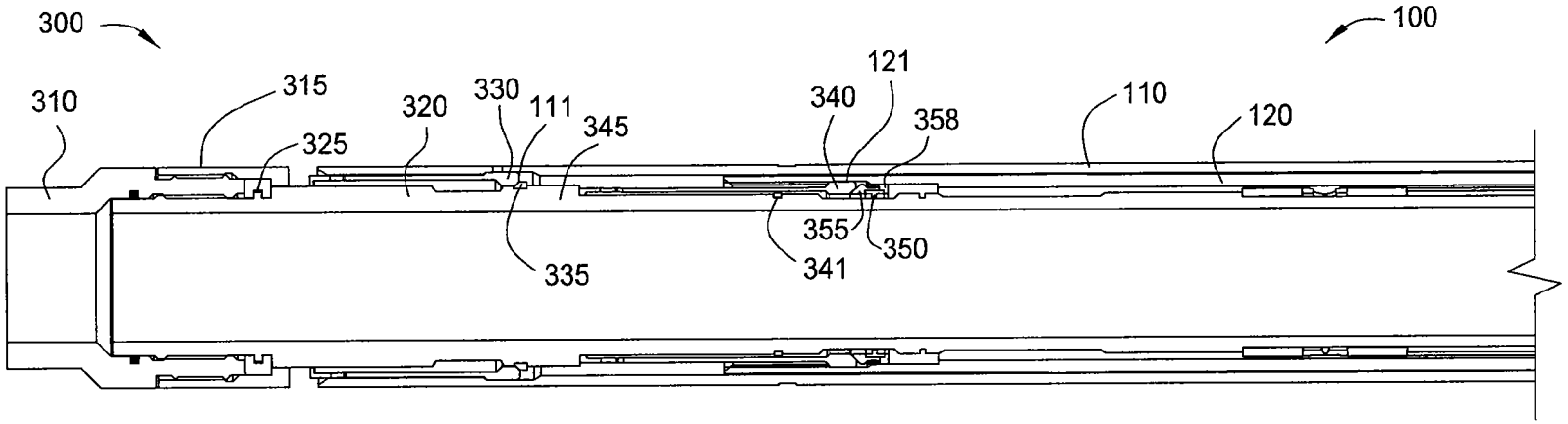
FIG. 3E shows the retrieval position of the latch and the anchor.

FIGS. 3B-3E show the operation of the latch 300 with respect to the anchor 100. FIGS. 3B-3C show the latch 300 as it engages and disengages from the anchor 100. FIGS. 3D-3E show the latch 300 as it selectively re-engages with the anchor 100 to unset and remove it from the wellbore. The same reference numerals relating to the anchor 100 will be used in FIGS. 3B-3E.

FIG. 3B shows the run-in/setting position of the latch 300 as it engages with the anchor 100. The shear ring 350 and shear ring housings 355 and 358 may land on a shoulder disposed along the inner surface of the setting sleeve 120. The setting member 340 may also engage the recess 121 along the inner surface of the setting sleeve 120 to connect the setting member 340 to the setting sleeve 120. At this point, the retrieving member 330 is not engaged with the recess 111 disposed along the inner surface of the retrieval sleeve 110. The shear ring housings 355 and 358 may be used to help the setting member 340 engage with the recess 121 on the setting sleeve 120.

Once the latch 300 is set in the-anchor 100 and assuming a whipstock is connected to the top of the latch 300, the wellbore operation may commence. During the wellbore operation, the shear ring housings 355 and 358 and the setting member 340 may keep the latch 300 engaged with the anchor 100. After the wellbore operation is complete, a pull force may be applied to the whipstock and thus the latch 300 to shear the shear ring 350.

FIG. 3C shows the disengaged position of the latch 300 from the anchor 100. When the shear ring 350 shears, the latch mandrel 320 may be pulled in an upward direction relative to the setting member 340 until the snap ring 341 engages the setting member and deflects the fingers out of the recess 121 on the setting sleeve 120 of the anchor 100, thereby disconnecting the latch 300 from the anchor 100. This may allow the latch 300 to disengage from the anchor 100 and be retrieved from the wellbore, along with the whipstock. The anchor 100 may then be selectively retrieved after the latch 300 is disengaged from the anchor 100 by reengaging the latch 300 with the anchor and unsetting the anchor.

FIG. 3D shows the re-engaged position of the latch 300 with the anchor 100. To selectively retrieve the anchor 100, the latch 300 may subsequently be reintroduced into the anchor 100 to engage the retrieving member 330 with the retrieval sleeve 110, thereby reconnecting the latch 300 to the anchor 100. The retrieving member 330 may engage the recess 111 disposed along the inner surface of the retrieval sleeve 110 because the sheared shear ring 350 will not prevent the latch mandrel 320 from being further introduced into the anchor 100. In addition, the top sleeve 315 may abut the retrieval sleeve 110 to prevent the latch 300 from being completely received through the anchor 100.

FIG. 3E shows the retrieval position of the latch 300 and the anchor 100. After the latch 300 is re-engaged with the anchor 100, i.e. when the fingers on the retrieving member 330 engage the recess 111 on the inner surface of the retrieval sleeve 110, the latch 300 may be pulled in an upward direction to remove the latch and the anchor. As the latch is pulled upward, the snap ring 335 abuts the retrieving member 330 to help keep the fingers engaged with the recess 111 of the retrieval sleeve 110, thereby locking the latch 300 to the anchor 100 to prevent disengagement therebetween as they are removed from the wellbore. The pull force applied to the latch 300 and thus the anchor 100 may then be directed to unset the anchor from the wellbore, via the retrieval sleeve 110 as discussed above with respect to FIG. 1C. Once the anchor 100 is unset, the tools may then be removed from the wellbore in one trip.

Figure 4A:
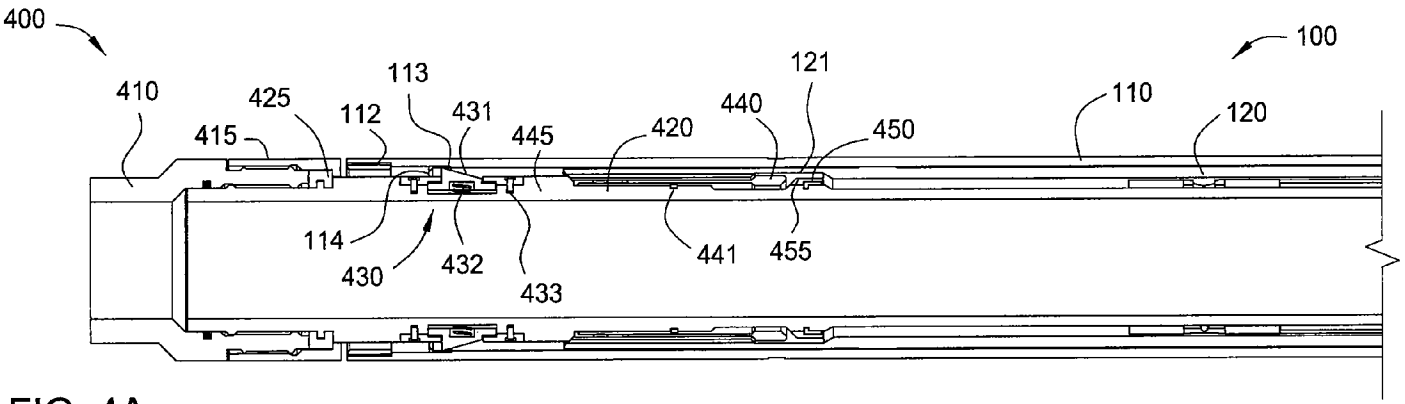
FIG. 4A is a cross-sectional view of a latch according to one embodiment of the present invention.

FIG. 4A shows a cross-sectional view of a latch 400 according to one embodiment of the present invention. The figure also shows the run-in position of the latch 400 as it is introduced into the anchor 100 and includes the same reference numerals with respect to the anchor 100. The latch 400 may include many of the same components as the latch 200 described above; these same components are identified with the same ending reference numerals as the latch 200 but will range in the 400's. The latch 400 may also operate in a substantially similar way as the latch 200. The main differences between the latch 400 and the latch 200 are the use of a retrieving member 430 that includes a spring loaded assembly. The latch 400 may also include a shoulder 445 instead of the biasing member 245 or the ramp 235. Finally, the anchor 100 may further include a retrieval ring 112 and a sliding sleeve 114.

The retrieving member 430 may include a plurality of dogs 431 disposed around the periphery of the shoulder 445 of the latch mandrel 420. The dogs 431 may be outwardly biased by biasing members 432, such as a spring. The dogs 431 and the springs 432 may be retained within the latch mandrel 420 by retaining members 433 that are bolted to the latch mandrel. The dogs and springs may be retained within the latch mandrel 420 so that the wings of the dogs project outwardly beyond the shoulder 445 of the latch mandrel.

The anchor 100 may further include the retrieval ring 112 having a cylindrical body disposed within the retrieval sleeve 110. The retrieval ring 112 may be connected to the inner surface of the longitudinal end of the retrieval sleeve 110 so that it projects beyond the inner surface of the sleeve 110. The sliding sleeve 114 may include a cylindrical body slideably disposed along the inner surface of the retrieval sleeve 110, between the retrieval ring 112 and a second shoulder 113 formed on the inner surface of the retrieval sleeve 110. The sliding sleeve 114 may also include a lip along its inner surface formed at the end of the sleeve adjacent to the retrieval ring 112.

Figure 4B:
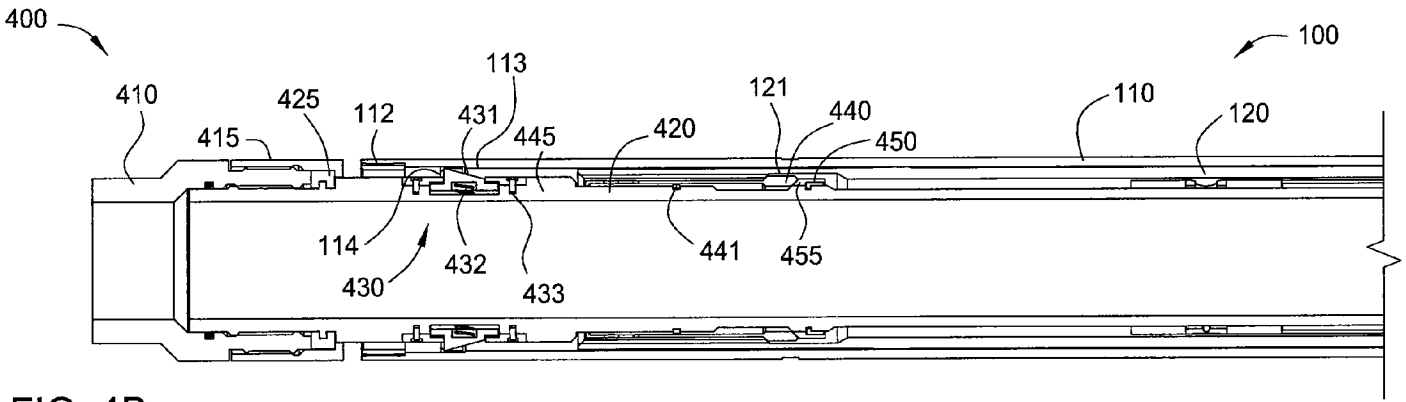
FIG. 4B shows the run-in/setting position of the latch with the anchor.
Figure 4C:
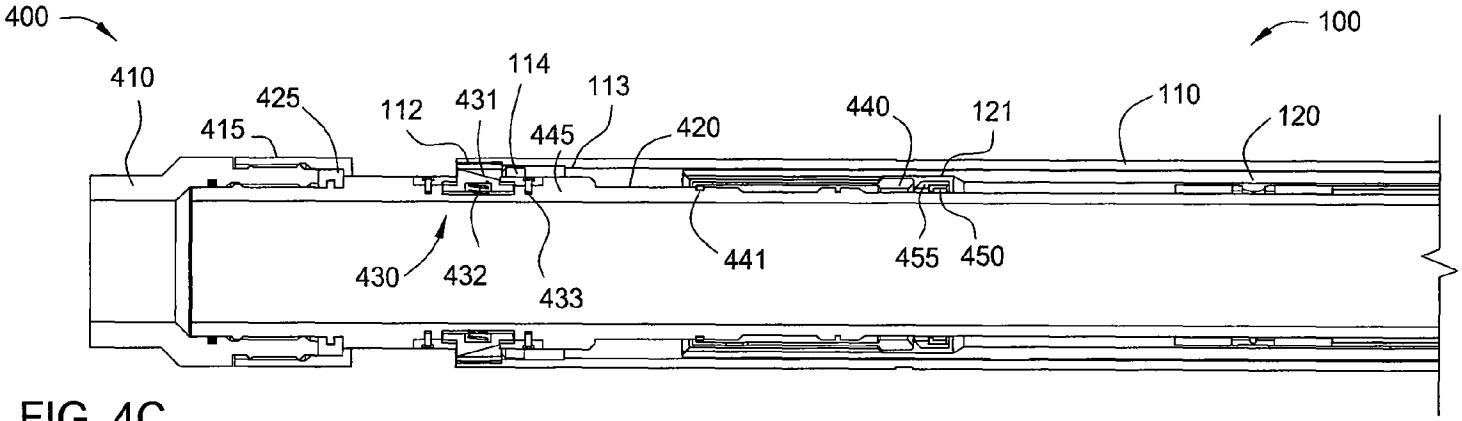
FIG. 4C shows the disengaged position of the latch from the anchor.
Figure 4D:
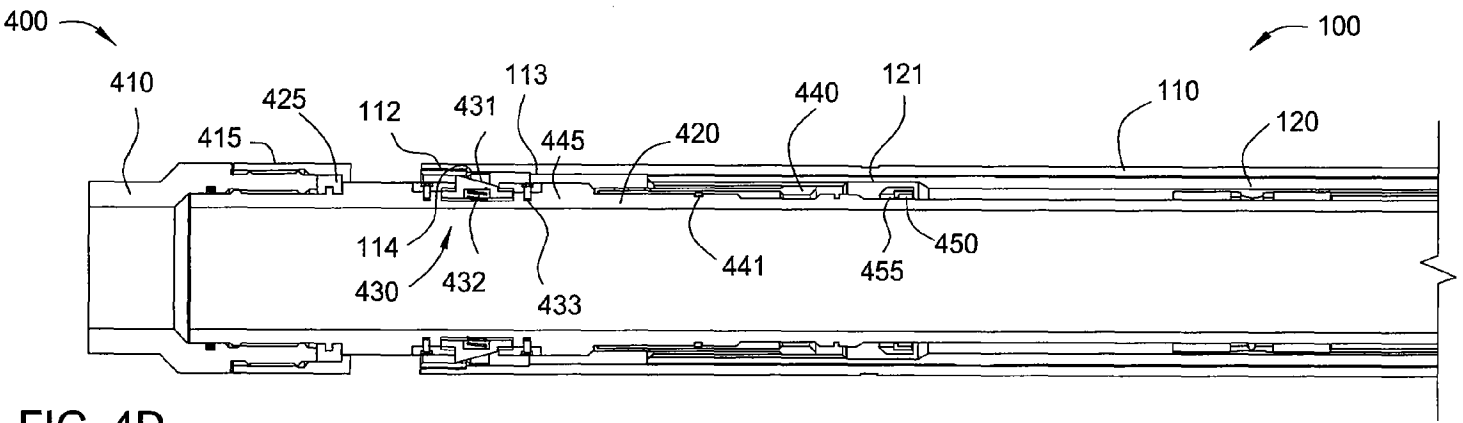
FIG. 4D shows the reintroduced position of the latch with the anchor.
Figure 4E:
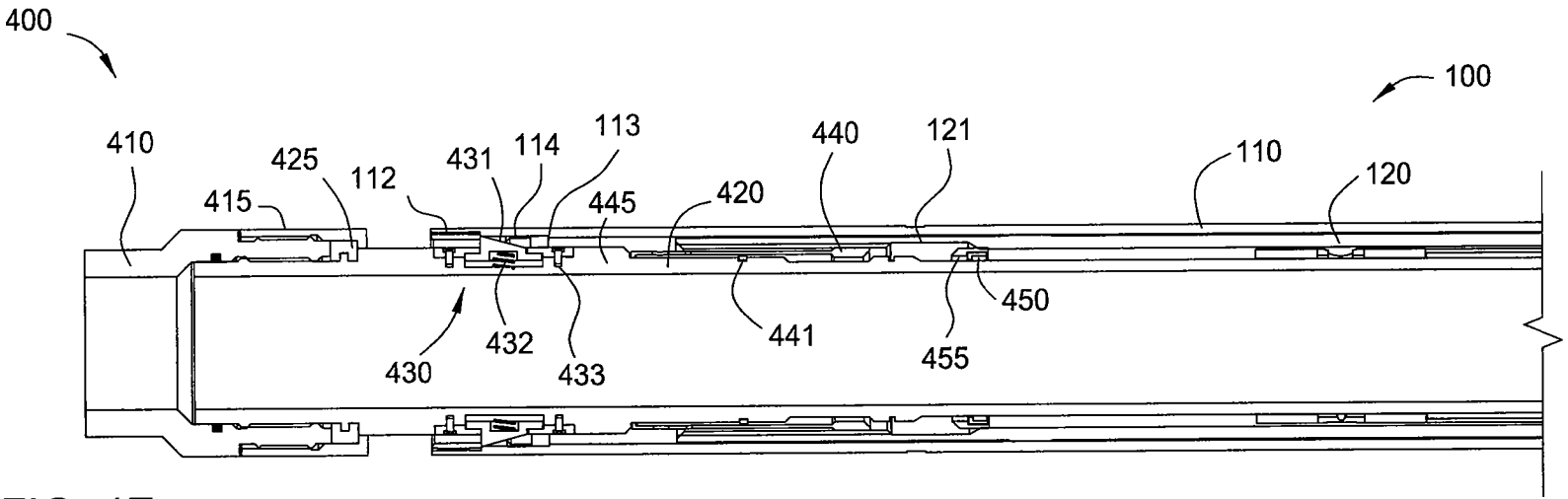
FIG. 4E shows the retrieval position of the latch and the anchor.

FIGS. 4B-4E show the operation of the latch 400 with respect to the anchor 100. FIGS. 4B-4C show the latch 400 as it engages and disengages from the anchor 100. FIGS. 4D-4E show the latch 400 as it selectively re-engages with the anchor 100 to unset and remove it from the wellbore. The same reference numerals relating to the anchor 100 will be used in FIGS. 4B-4E.

FIG. 4B shows the run-in/setting position of the latch 400 as it engages with the anchor 100. The shoulder 445 of the latch mandrel 420 may land on a shoulder disposed along the inner surface of the setting sleeve 120. The setting member 440 may also engage the recess 121 along the inner surface of the setting sleeve 120 to connect the setting member 440 to the setting sleeve 120. At this point, the shear ring housing 455 may be used to help the setting member 440 engage with the recess 121 on the setting sleeve 120. During the introduction of the latch 400 into the anchor 100, the dogs 431 of the retrieving member 430 may be biased inward past the retrieval ring 112 and the lip of the sliding sleeve 114. The sliding sleeve 114 may abut the second shoulder formed on the inner surface of the retrieval sleeve 110, which limits its travel relative to the dogs 431.

Once the latch 400 is set in the anchor 100 and assuming a whipstock is connected to the top of the latch 400, the wellbore operation may commence. During the wellbore operation, the shear ring housing 455 and the setting member 440 keeps the latch 400 engaged with the anchor 100. After the wellbore operation is complete, a pull force may be applied to the whipstock and thus the latch 400 to shear the shear ring 450.

FIG. 4C shows the disengaged position of the latch 400 from the anchor 100. When the shear ring 450 shears, the latch mandrel 420 may be pulled in an upward direction relative to the setting member 440 until the snap ring 441 engages the setting member and deflects the fingers out of the recess 121 on the setting sleeve 120 of the anchor 100. thereby disconnecting the latch 400 from the anchor 100. Also, as the latch 400 is removed, the wings of the dogs 431 engage with the lip of the sliding sleeve 114 and slide the sleeve upward until it abuts the retrieval ring 112. The lip of the sliding sleeve 114 may direct the dogs 431 past the edge of the retrieval ring 112 and allow the latch 400 to be fully removed from the anchor 100. This may allow the latch 400 to disengage from the anchor 100 and be retrieved from the wellbore, along with the whipstock. The anchor 100 may then be selectively retrieved after the latch 400 is disengaged from the anchor 100 by reengaging the latch 300 with the anchor and unsetting the anchor.

FIG. 4D shows the reintroduced position of the latch 400 with the anchor 100. To selectively retrieve the anchor 100, the latch 400 may subsequently be reintroduced into the anchor 100 to engage the retrieving member 430 with the retrieval ring 112, thereby reconnecting the latch 400 to the anchor 100. As the latch 400 is reintroduced, the wings of the dogs 431 contact the lip of the sliding sleeve 112 and direct the sliding sleeve 112 away from the edge of the retrieval ring 112. In addition, the top sleeve 415 may abut the retrieval sleeve 110 to prevent the latch 400 from being completely received through the anchor 100.

FIG. 4E shows the retrieval position of the latch 400 and the anchor 100. After the latch 400 is re-engaged with the anchor 100, i.e. when the wings of the dogs 431 of the retrieving member 430 engage the edge of the retrieval ring 112, the latch 400 may be pulled in an upward direction to remove the latch and the anchor. As the latch is pulled upward, the biasing members bias the dogs 431 outward to help keep them engaged with the retrieval ring 112, thereby locking the latch 400 to the anchor 100 to prevent disengagement therebetween as they are removed from the wellbore. The pull force applied to the latch 400 and thus the anchor 100 may then be directed to unset the anchor from the wellbore, via the retrieval sleeve 110 as discussed above with respect to FIG. 1C. Once the anchor 100 is unset, the tools may then be removed from the wellbore in one trip.

Figure 5A:
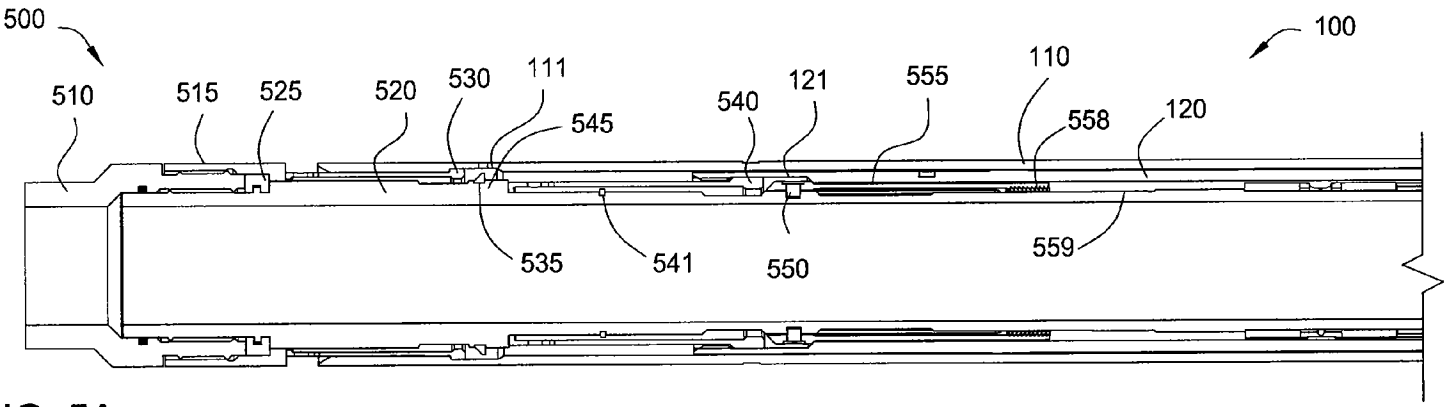
FIG. 5A is a cross-sectional view of a latch according to one embodiment of the present invention.

FIG. 5A shows a cross-sectional view of a latch 500 according to one embodiment of the present invention. The figure also shows the run-in position of the latch 500 as it is introduced into the anchor 100 and includes the same reference numerals with respect to the anchor 100. The latch 500 may include many of the same components as the latch 200 described above; these same components are identified with the same ending reference numerals as the latch 200 but will range in the 500's. The latch 500 may also operate in a substantially similar way as the latch 200. The main differences between the latch 500 and the latch 200 are the use of a shoulder 545 and a snap ring 535, instead of the biasing member 245 and the ramp 235. The latch 500 may also include a collet 555 and a lock ring 558, instead of the upper and lower shear ring housings 255 and 258. Finally, the latch 500 may further include teeth 559 disposed along the surface of the latch mandrel 520 adapted to engage with the body lock ring 558.

The shoulder 545 may be formed from the latch mandrel 520 and may abut the setting member 540. The snap ring 535 may be disposed on the shoulder 545 and may be adapted to engage the retrieving member 530. One end of the collet 555 may be releaseably connected to the latch mandrel 520 by shear screws 550. This end of the collet 555 may be used to help engage the setting member 540 with the recess 121 disposed along the inner surface of the setting sleeve 120 of the anchor 100. At the opposite end, the collet 555 may include the lock ring 558. The lock ring 558 may be substantially similar to the lock ring 155 as described with respect to the anchor 100, but the lock ring 558 does not include any shoulders disposed on its outermost surface. After the shear screws 550 are sheared, the collet 555 may be slideably disposed along the outer surface of the latch mandrel 520 to allow the lock ring 558 to engage with the teeth 559.

Figure 5B:
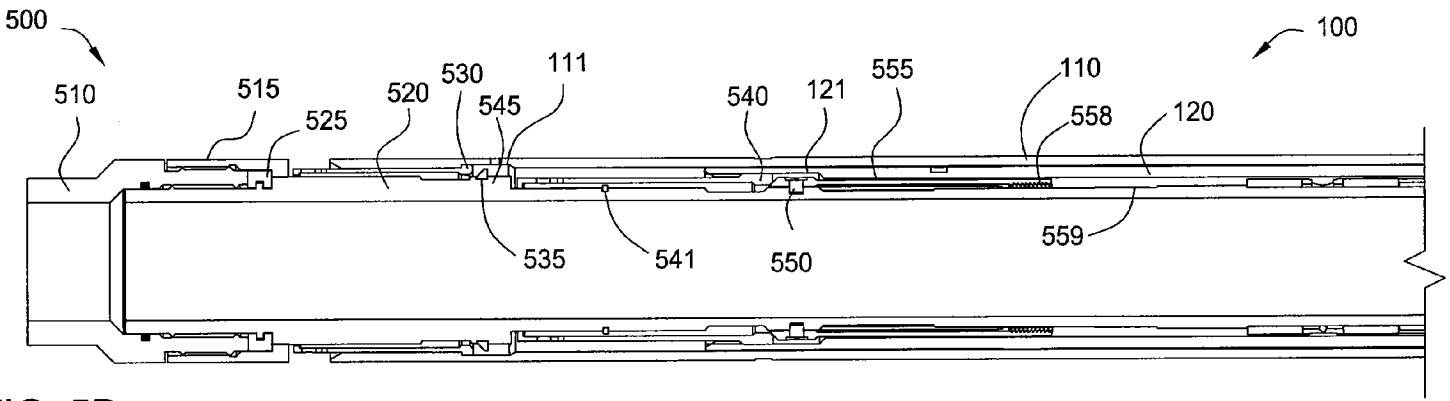
FIG. 5B shows the run-in/setting position of the latch with the anchor.
Figure 5C:
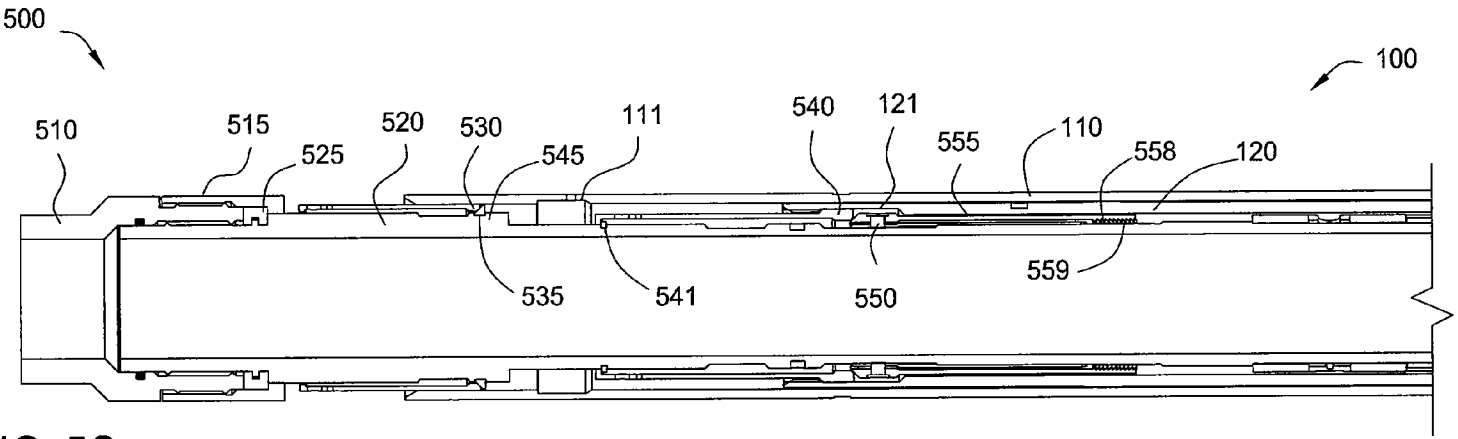
FIG. 5C shows the disengaged position of the latch from the anchor.
Figure 5D:
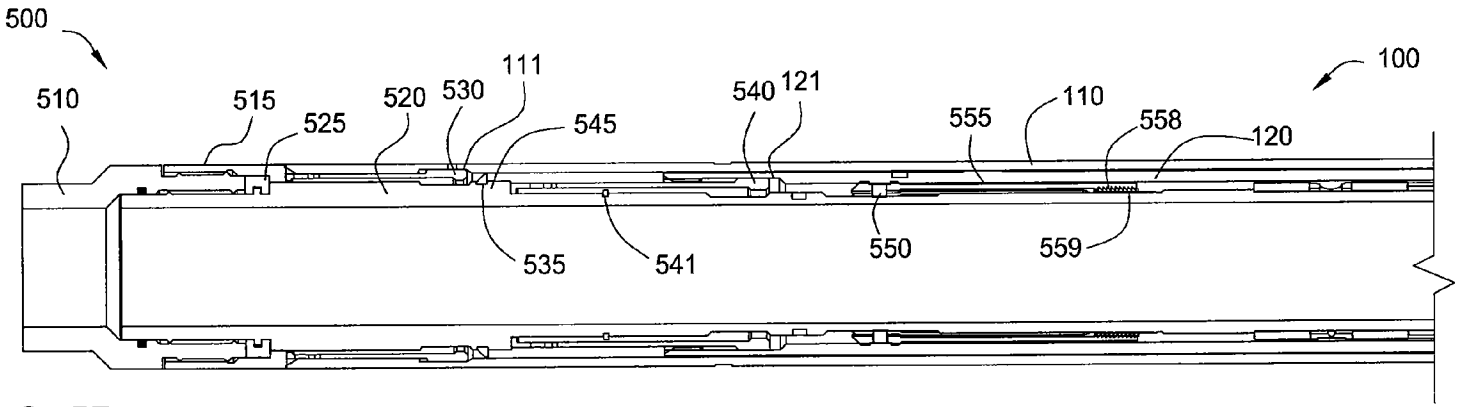
FIG. 5D shows the re-engaged position of the latch with the anchor.
Figure 5E:
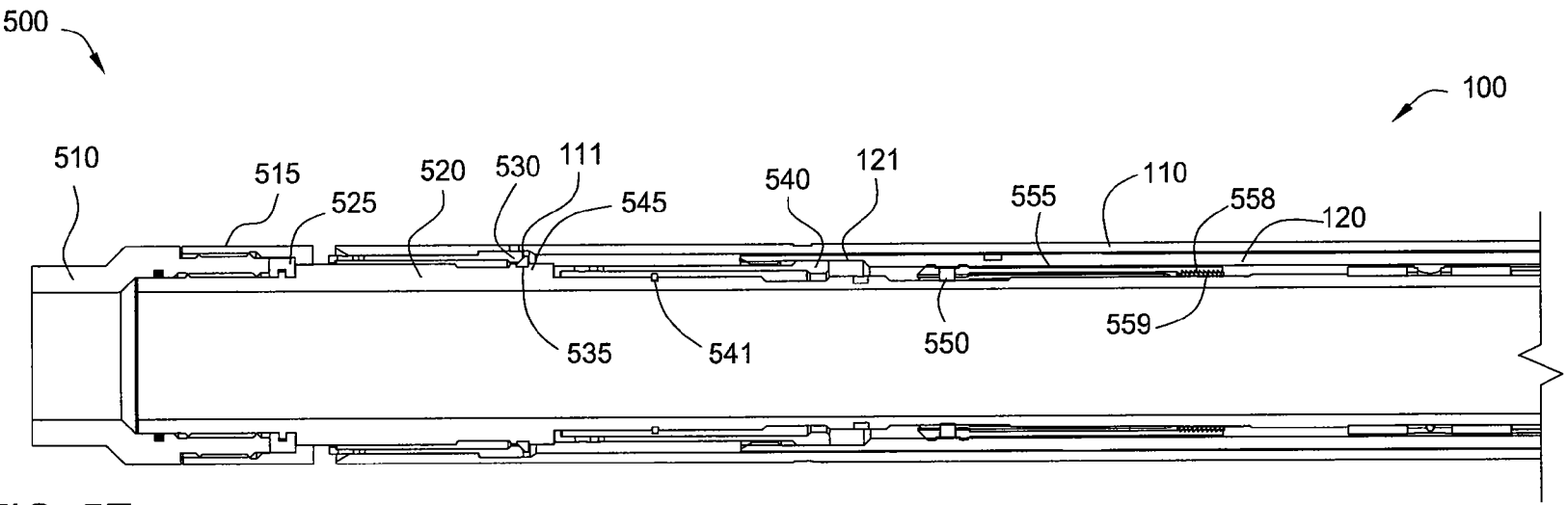
FIG. 5E shows the retrieval position of the latch and the anchor.

FIGS. 5B-5E show the operation of the latch 500 with respect to the anchor 100. FIGS. 5B-5C show the latch 500 as it engages and disengages from the anchor 100. FIGS. 5D-5E show the latch 500 as it selectively re-engages with the anchor 100 to unset and remove it from the wellbore. The same reference numerals relating to the anchor 100 will be used in FIGS. 5B-5E.

FIG. 5B shows the run-in/setting position of the latch 500 as it engages with the anchor 100. The end of the collet 555 may land on a shoulder disposed along the inner surface of the setting sleeve 120. The setting member 540 may also engage the recess 121 along the inner surface of the setting sleeve 120 to connect the setting member 540 to the setting sleeve 120. At this point, the retrieving member 530 is not engaged with the recess 111 disposed along the inner surface of the retrieval sleeve 110. The end of the collet 555 may be used to help the setting member 540 engage with the recess 121 on the setting sleeve 120.

Once the latch 500 is set in the anchor 100 and assuming a whipstock is connected to the top of the latch 500, the wellbore operation may commence. During the wellbore operation, the end of the collet 555 and the setting member 540 may keep the latch 500 engaged with the anchor 100. After the wellbore operation is complete, a pull force may be applied to the whipstock and thus the latch 500 to shear the shear screws 550.

FIG. 5C shows the disengaged position of the latch 500 from the anchor 100. When the shear screws 550 shear, the latch mandrel 520 may be pulled in an upward direction relative to the setting member 540 until the snap ring 541 engages the setting member and deflects the fingers out of the recess 121 on the setting sleeve 120 of the anchor 100, thereby disconnecting the latch 500 from the anchor 100. The collet 555 also slides along the outer surface of the latch mandrel 520 until the body lock ring 558 engages with the teeth 529 to prevent the collet 555 from sliding back up the latch mandrel in the opposite direction. This may allow the latch 500 to disengage from the anchor 100 and be retrieved from the wellbore, along with the whipstock. The anchor 100 may then be selectively retrieved after the latch 500 is disengaged from the anchor 100 by reengaging the latch 500 with the anchor and unsetting the anchor.

FIG. 5D shows the re-engaged position of the latch 500 with the anchor 100. To selectively retrieve the anchor 100, the latch 500 may subsequently be reintroduced into the anchor 100 to engage the retrieving member 530 with the retrieval sleeve 110, thereby reconnecting the latch 500 to the anchor 100. The retrieving member 530 engages the recess 111 disposed along the inner surface of the retrieval sleeve 110 because the sheared shear screws 350 and thus the collet 555 will not prevent the latch mandrel 520 from being further introduced into the anchor 100. In addition, the top sleeve 515 may abut the retrieval sleeve 110 to prevent the latch 500 from being completely received through the anchor 100.

FIG. 5E shows the retrieval position of the latch 500 and the anchor 100. After the latch 500 is re-engaged with the anchor 100, i.e. when the fingers on the retrieving member 530 engage the recess 111 on the inner surface of the retrieval sleeve 110, the latch 500 may be pulled in an upward direction to remove the latch and the anchor. As the latch is pulled upward, the snap ring 535 abuts the retrieving member 530 to help keep the fingers engaged with the recess 111 of the retrieval sleeve 110, thereby locking the latch 500 to the anchor 100 to prevent disengagement therebetween as they are removed from the wellbore. The pull force applied to the latch 500 and thus the anchor 100 may then be directed to unset the anchor from the wellbore, via the retrieval sleeve 110 as discussed above with respect to FIG. 1C. Once the anchor 100 is unset, the tools may then be removed from the wellbore in one trip.

FIG. 6 shows a cross sectional view of a whipstock 600 according to one embodiment of the present invention. The whipstock 600 includes a top end that may be releasably connected to a run-in tool (not shown) by a shear stud (not shown) via opening 605. In one embodiment, the whipstock 600 may be releasably connected to a drill bit of a drill string to allow immediate commencement of a drilling operation upon positioning the whipstock 600 in the wellbore. The whipstock 600 may includes a cylindrical outer metal body 610 and an arcuate inner concave face 615. The concave face 615 may define an angled edge from the top end of the whipstock to a bottom end of the whipstock. The concave face 615 may be adapted to receive and direct a drill bit (not shown) outwardly against the surrounding wellbore casing during the sidetrack drilling operation.

The outer metal body 610 may include teeth 620 at the top end of whipstock 600. The teeth 620 may be used to facilitate retrieval of the whipstock, such as with a retrieval tool, and/or to grip against the wellbore casing when the whipstock 600 is directing a drill bit into the side of the casing. The outer metal body 610 may include a recess 625 near the center of the whipstock 600 that may also be used to facilitate retrieval of the whipstock 600. The bottom end of the whipstock 600 may include a connecting member 630 for connection to the top sub of the latch embodiments discussed herein.

The whipstock may be connected to the latch embodiments in a variety of other ways known by one with ordinary skill in the art. The whipstock may also include a variety of types of whipstocks known in the art. Once the whipstock is attached to the latch, the tools may be lowered by a run-in tool to engage with the anchor, discussed herein to commence the wellbore operations. After the wellbore operations are complete, the whipstock and the latch may be retrieved by a retrieving tool, and the anchor may be selectively retrieved while the retrieving tool is down hole to remove all three tools in one trip.

In the embodiments discussed herein, the assembly, including the whipstock and the anchor, may be in a first configuration to enable the whipstock to be retrieved from the wellbore independent from the anchor. The assembly may also be operable into a second configuration to enable the whipstock to be retrieved from the wellbore with the anchor. The retrieval of the whipstock and/or the anchor may be conducted in a single trip into the wellbore. Operation of the assembly from the first configuration to the second configuration may be conducted upon initial positioning of the assembly in the wellbore or during retrieval of the assembly from the wellbore.

In the embodiments discussed herein, the assembly, including the whipstock, the latch, and the anchor, may be in a first configuration to enable the whipstock and the latch to be retrieved from the wellbore independent from the anchor. The assembly may also be operable into a second configuration to enable the whipstock and the latch to be retrieved from the wellbore with the anchor. The retrieval of the whipstock and the latch and/or the anchor may be conducted in a single trip into the wellbore. Operation of the assembly from the first configuration to the second configuration may be conducted upon initial positioning of the assembly in the wellbore or during subsequent retrieval of the assembly from the wellbore.

In one embodiment, the assembly, including at least the whipstock and the anchor, may be positioned in the wellbore and may operable to enable retrieval of the whipstock with the anchor. The assembly may be positioned and configured during a single trip into the wellbore. For example, during a single trip into the wellbore, the whipstock and the anchor may be positioned in the wellbore (or alternatively the whipstock may be positioned into the wellbore to engage the anchor previously set in the wellbore), and the whipstock may then be disengaged and re-engaged with the anchor into the configuration that enables the whipstock to be retrievable with the anchor, as discussed above. Thereafter, a wellbore operation may be conducted. In one embodiment, the wellbore operation may be performed during the single trip into the wellbore in which the assembly is positioned and configured. Upon completion of the wellbore operation, a retrieval tool may be used to engage the assembly and retrieve the whipstock with the anchor during a subsequent single trip into the wellbore, without having to disengage or re-engage the whipstock to the anchor to retrieve both components. In an alternative embodiment, upon completion of the wellbore operation, the whipstock and the anchor may be retrieved during the single trip into the wellbore in which the assembly is positioned and configured and the wellbore operation is conducted.

A method of forming a second wellbore from a primary wellbore will also be described by utilizing the different embodiments of the downhole tools described herein. The method may begin with the steps of forming a primary wellbore, lowering an anchor into the primary wellbore at a location where a second wellbore is to be formed, and setting the anchor in the primary wellbore. Setting the anchor may include longitudinally and rotationally securing the anchor relative to the primary wellbore and forming a sealed engagement between the anchor and the primary wellbore.

In another embodiment, a method of forming a second wellbore from a primary wellbore includes lowering a whipstock with a latch connected to the lower end of the whipstock into the primary wellbore and engaging the latch with the anchor. The whipstock may be connected to the latch using a splined connection. The method also includes orienting the whipstock and the latch in a direction where the second wellbore is to be formed. A wellbore operation, such as a pressure test, may be conducted above and/or below the anchor. Another wellbore operation, such as a drilling operation, is conducted to form the second wellbore, wherein a drill string is directed into a sidewall of the primary wellbore by the whipstock.

After the second wellbore is formed, the whipstock and latch may be retrieved in one trip into the primary wellbore, and the anchor may be selectively retrieved during the same trip if desired. The retrieval process includes lowering a retrieval tool to engage the whipstock during a retrieval operation, wherein the retrieval operation includes lowering the retrieval tool into the primary wellbore and subsequently removing the tool from the primary wellbore. The whipstock and the latch are disengaged from the anchor during the retrieval operation. Then, the retrieval tool, the whipstock, and the latch are retrieved from the primary wellbore.

In another embodiment, the anchor is selectively retrieved with the latch and the whipstock during the retrieval operation. Selectively retrieving the anchor may include lowering the whipstock and the latch to re-engage with the anchor. After re-engaging the latch with the anchor, the anchor is unset from the primary wellbore. The retrieval tool, the whipstock, the latch, and the anchor may then be retrieved from the primary wellbore.

In one embodiment, a method of retrieving a drilling assembly during a single trip into a wellbore comprises positioning the drilling assembly in the wellbore, wherein the drilling assembly includes a first section and a second section; and deciding between retrieving the first section of the drilling assembly or retrieving a combination of the first section and the second section of the drilling assembly, after positioning the drilling assembly in the wellbore. The first section may include a whipstock and a latch, and the second section may include an anchor.

The method may further comprise deciding to retrieve the first section of the drilling assembly and retrieving the first section of the drilling assembly from the wellbore during the single trip into the wellbore.

The method may further comprise deciding to retrieve the combination of the first section and the second section of the drilling assembly and retrieving the combination of the first section and the second section of the drilling assembly from the wellbore during the single trip into the wellbore.

In one embodiment, a method of conducting a sidetrack drilling operation comprises positioning a sidetrack drilling assembly in a main wellbore, wherein the sidetrack drilling assembly includes a first section and a second section; forming a lateral wellbore from the main wellbore with the sidetrack drilling assembly; and choosing between removing the first section of the sidetrack drilling assembly or removing a combination of the first section and the second section of the sidetrack drilling assembly, after positioning the sidetrack drilling assembly in the main wellbore. The first section may include a whipstock and a latch, and the second section may include an anchor.

The method may further comprise choosing to remove the first section of the sidetrack drilling assembly and removing the first section of the sidetrack drilling assembly.

The method may further comprise choosing to remove the combination of the first section and the second section of the sidetrack drilling assembly and removing the combination of the first section and the second section of the sidetrack drilling assembly.

In one embodiment, a method of selectively retrieving an anchor from a wellbore comprises setting the anchor in the wellbore; engaging the anchor with a latch, wherein the latch is connected to a whipstock; retrieving the latch and the whipstock from the wellbore; and selectively retrieving the anchor with the latch and the whipstock from the wellbore. Selectively retrieving the anchor with the latch and the whipstock may include re-engaging the latch with the anchor. The method may further comprise disengaging the latch from the anchor and deciding to selectively retrieve the anchor after setting the anchor in the wellbore.

In one embodiment, an apparatus for selectively retrieving an anchor from a wellbore comprises a body; a setting member disposed around the body and adapted to engage the anchor; and a retrieving member disposed around the body and adapted to selectively retrieve the anchor from the wellbore. The setting member and/or the retrieving member may include a collet. A biasing member adjacent the setting member may be used to bias the setting member into engagement with the anchor. Also, a shearable member may be used to facilitate engagement of the setting member with the anchor and may be operable to temporarily prevent engagement of the retrieving member with the anchor. A release mechanism may be used to disengage the setting member from the anchor. The retrieving member may also be adapted to engage the anchor. A ramp may be used to bias the retrieving member into engagement with the anchor. The retrieving member may include a spring loaded assembly having a plurality of dogs, wherein the dogs are outwardly biased to engage the anchor.

The apparatus may further comprise a top connection member coupled to the body by a splined connection. The top connection member may be operable to connect the body to a whipstock, and the splined connection may be operable to orient the body and the whipstock prior to engagement of the setting member with the anchor. A key may be disposed on the body to orient the body prior to engagement of the setting member with the anchor.

In one embodiment, a sidetrack drilling assembly for use in a wellbore comprises a whipstock; a latch coupled to the whipstock; and an anchor, wherein the latch is operable to selectively retrieve the anchor. The anchor may comprise a slip assembly operable to axially fix the anchor in the wellbore and a packing element, and the latch may comprise a landing sleeve operable to protect a seal assembly disposed around the latch upon engagement with the anchor.

In one embodiment, the slip assembly may comprise a housing; a first cone and a second cone each slideably disposed in the housing; and a slip member disposed in the housing, wherein the first cone and the second cone are operable to project the slip member into engagement with the wellbore. At least one of the first cone and the second cone may be coupled to the anchor to prevent rotation between the slip assembly and the anchor. The housing may be coupled to the anchor to prevent rotation between the slip assembly and the anchor.

In one embodiment, the anchor may further comprise a retrieval sleeve; a setting sleeve surrounded by the retrieval sleeve; and an inner mandrel partially surrounded by and releasably coupled to the retrieval sleeve. The setting sleeve may be coupled to the inner mandrel to facilitate setting of the anchor. The retrieval sleeve may be uncoupled from the inner mandrel to facilitate setting of the anchor. The inner mandrel may comprise an orientation cut to orient the latch and whipstock upon engagement between the latch and the anchor.

In one embodiment, the latch may further comprise a setting member operable to engage with the setting sleeve of the anchor and a retrieving member operable to engage with the retrieval sleeve of the anchor to selectively retrieve the anchor from the wellbore. The setting member and/or the retrieving member may include a collet. The latch may further comprise a key operable to engage the orientation cut on the inner mandrel to orient the latch and the whipstock in the wellbore.

In one embodiment, a method of retrieving an anchor in a wellbore comprises setting the anchor in the wellbore; engaging the anchor with a latch; disengaging the latch from the anchor; re-engaging the anchor with the latch, thereby unsetting the anchor; and retrieving the anchor with the latch from the wellbore.

While the foregoing is directed to embodiments of the invention, other and further embodiments of the invention may be devised without departing from the basic scope thereof, and the scope thereof is determined by the claims that follow. For example, a variety of different types of conventional wellbore tubulars, such as coiled tubing and drill pipe, may be utilized in the embodiments discussed herein.

We claim:

1. A method of retrieving an assembly having a whipstock coupled to an anchor from a wellbore, comprising:

releasing the whipstock from the anchor in the wellbore;

re-engaging the whipstock to the anchor; and retrieving the whipstock with the anchor from the wellbore.

2. The method of claim 1, wherein the assembly further comprises a latch that couples the whipstock to the anchor, and wherein the latch is operable to release the whipstock from the anchor.

3. The method of claim 2, wherein the latch is operable to re-engage the whipstock to the anchor.

4. The method of claim 3, wherein retrieving the whipstock with the anchor comprises retrieving the whipstock and the latch with the anchor from the wellbore.

5. The method of claim 1, wherein the anchor comprises at least one of a slip and a packing element configured to engage an inner surface of the wellbore.

6. The method of claim 1, wherein the anchor comprises a retrieval sleeve configured to facilitate retrieval of the anchor from the wellbore, and a setting sleeve configured to facilitate setting of the anchor in the wellbore.

7. The method of claim 1, further comprising releasing the anchor from the wellbore after re-engaging the whipstock to the anchor.

8. A method of retrieving an assembly having a whipstock and an anchor from a wellbore during a single trip into the wellbore, comprising:

securing the assembly in the wellbore, wherein the assembly is operable into a first configuration where the whipstock is released from anchor downhole so that the whipstock can be retrieved from the wellbore, and a second configuration where the whipstock and the anchor can be retrieved together from the wellbore;

operating the assembly in the wellbore to retrieve the whipstock or to retrieve the whipstock with the anchor; and retrieving at least the whipstock from the wellbore.

9. The method of claim 8, wherein retrieving at least the whipstock comprises retrieving the whipstock independent of the anchor from the wellbore.

10. The method of claim 8, further comprising retrieving the anchor with the whipstock from the wellbore.

11. A method of retrieving an assembly during a single trip into a wellbore using a retrieval tool, comprising:

lowering the retrieval tool in the wellbore to retrieve the assembly, wherein the assembly comprises a whipstock and an anchor;

releasing the whipstock from the anchor downhole;

re-engaging the whipstock with the anchor downhole;

releasing the anchor from engagement with the wellbore; and retrieving the whipstock and the anchor from the wellbore in the single trip into the wellbore.

12. A method of retrieving an anchor from a wellbore, comprising:

engaging a first portion of the anchor with a latch;

disengaging the latch from the first portion of the anchor;

engaging a second portion of the anchor with the latch after the latch is disengaged from the first portion of the anchor;

unsetting the anchor using the latch; and retrieving the anchor with the latch from the wellbore.

13. A method of operating an assembly having a whipstock and an anchor in a wellbore, comprising:

setting the assembly in the wellbore, wherein the assembly further comprises a disconnection member and a reconnection member between the whipstock and the anchor, and wherein the assembly is operable into a first configuration where the whipstock is released from anchor downhole so that the whipstock can be retrieved from the wellbore, and a second configuration where the whipstock and the anchor can be retrieved together from the wellbore;

operating the disconnection member to separate the whipstock from the anchor; and retrieving at least the whipstock from the wellbore.

14. The method of claim 13, wherein the disconnection member comprises a collet.

15. The method of claim 13, wherein the reconnection member comprises a collet.

16. The method of claim 13, wherein the reconnection member comprises a spring loaded assembly having a plurality of biasing members and a plurality of dogs.

17. A method of operating an assembly having a whipstock and an anchor in a wellbore, comprising:

setting the assembly in the wellbore, wherein the whipstock is releasably connected to the anchor in a first configuration, and wherein the whipstock is locked to the anchor in a second configuration such that the whipstock and the anchor are jointly retrievable from the wellbore;

releasing the whipstock from the anchor using a retrieval tool; and retrieving at least the whipstock from the wellbore.

18. The method of claim 17, wherein in the second configuration the whipstock is prevented from disengagement from the anchor using the retrieval tool.

19. A method of using an assembly having an anchor and a whipstock in a wellbore, comprising:

positioning the anchor in the wellbore;

positioning the whipstock in the wellbore; and operating the assembly to enable retrieval of the whipstock with the anchor, wherein positioning the whipstock and operating the assembly are performed in a first trip into the wellbore, and wherein the whipstock is releasable from the anchor downhole.

20. The method of claim 19, further comprising retrieving the whipstock and the anchor during a second trip into the wellbore.

21. The method of claim 19, wherein positioning the anchor is performed in the first trip into the wellbore.

22. The method of claim 19, wherein the anchor is positioned in the wellbore before the whipstock is positioned in the wellbore.

23. The method of claim 19, further comprising conducting a wellbore operation.

24. The method of claim 23, wherein the wellbore operation includes a drilling operation.

25. An apparatus for selectively retrieving an anchor from a wellbore, comprising:

a body;

a setting member coupled to the body and operable to engage the anchor; and a retrieving member slideably disposed on an outer surface of the body above the setting member and operable to selectively retrieve the anchor from the wellbore, wherein the setting member is operable to engage the anchor prior to the retrieving member.

26. The apparatus of claim 25, wherein the setting member comprises a collet operable to engage the anchor.

27. The apparatus of claim 25, further comprising a biasing member coupled to the body adjacent the setting member, wherein the biasing member is operable to bias the setting member into engagement with the anchor.

28. The apparatus of claim 25, further comprising a release mechanism coupled to the body and operable to disengage the setting member from the anchor.

29. The apparatus of claim 25, wherein the retrieving member comprises a collet operable to engage the anchor upon disengagement between the setting member and the anchor.

30. The apparatus of claim 25, further comprising a ramp coupled to the body adjacent the retrieving member, wherein the ramp is operable to bias the retrieving member into engagement with the anchor upon disengagement between the setting member and the anchor.

31. The apparatus of claim 25, wherein the retrieving member comprises a spring loaded assembly having a plurality of biasing members and a plurality of dogs, wherein the biasing members outwardly bias the dogs to engage the anchor.

32. A sidetrack drilling apparatus for use in a wellbore, comprising:

an assembly having a whipstock and an anchor, wherein the whipstock is releasably connected to the anchor in a first configuration, wherein the whipstock is locked to the anchor in a second configuration such that the whipstock and the anchor are jointly retrievable from the wellbore.

33. The apparatus of claim 29, wherein the assembly further comprises a latch that releasably connects the whipstock to the anchor.

34. The apparatus of claim 29, wherein the assembly further comprises a latch that locks the whipstock to the anchor.

35. A sidetrack drilling apparatus for use in a wellbore, comprising:

a whipstock;

a latch coupled to the whipstock; and an anchor, wherein the whipstock is releasably coupled to the anchor via the latch downhole, and wherein the anchor is operable to be selectively retrieved from the wellbore using the latch.

36. A method of operating an assembly having a whipstock and an anchor in a wellbore, comprising:

setting the assembly in the wellbore, wherein the whipstock is releasably connected to the anchor in a first configuration, and wherein the whipstock is locked to the anchor in a second configuration;

releasing the whipstock from the anchor using a retrieval tool, wherein when in the second configuration the whipstock is prevented from disengagement from the anchor using the retrieval tool; and retrieving at least the whipstock from the wellbore.

* * * * *

UNITED STATES PATENT AND TRADEMARK OFFICE

CERTIFICATE OF CORRECTION

PATENT NO. : 7,997,336 B2
APPLICATION NO. : 12/184785
DATED : August 16, 2011
INVENTOR(S) : Sokol et al.

It is certified that error appears in the above-identified patent and that said Letters Patent is hereby corrected as shown below:

Column 22, Claim 33, Line 32, please delete "29" and insert --32-- therefor;

Column 22, Claim 34, Line 35, please delete "29" and insert --32-- therefor.

Signed and Sealed this
Twenty-ninth Day of November, 2011

David J. Kappos

David J. Kappos
*Director of the United States Patent and Trademark Office*